US009139888B2

(12) United States Patent
Tyl

(10) Patent No.: US 9,139,888 B2
(45) Date of Patent: Sep. 22, 2015

(54) ROD OR WIRE MANUFACTURING SYSTEM, RELATED METHODS, AND RELATED PRODUCTS

(71) Applicant: Thermcraft, Inc., Winston-Salem, NC (US)

(72) Inventor: Thomas W. Tyl, Siler City, NC (US)

(73) Assignee: Thermcraft, Inc., Winston-Salem, NC (US)

( * ) Notice: Subject to any disclaimer, the term of this patent is extended or adjusted under 35 U.S.C. 154(b) by 32 days.

(21) Appl. No.: 13/964,620

(22) Filed: Aug. 12, 2013

(65) Prior Publication Data

US 2014/0159286 A1 Jun. 12, 2014

Related U.S. Application Data

(63) Continuation of application No. 12/373,872, filed as application No. PCT/US2007/073549 on Jul. 14, 2007, now Pat. No. 8,506,878, application No. 12/373,872, which is a continuation-in-part of application No. 11/487,044, filed on Jul. 14, 2006, now abandoned.

(51) Int. Cl.
*C21D 9/52* (2006.01)
*C21D 1/63* (2006.01)
(Continued)

(52) U.S. Cl.
CPC ..... *C21D 9/525* (2013.01); *C21D 1/63* (2013.01); *C21D 1/64* (2013.01); *C21D 8/06* (2013.01); *C21D 9/54* (2013.01); *C21D 9/5732* (2013.01); *C21D 1/60* (2013.01); *Y10T 29/49* (2015.01)

(58) Field of Classification Search
CPC ..... C21D 1/63; C21D 1/64; C21D 9/54; C21D 9/525; C21D 9/5732
USPC ..... 266/112, 113, 114, 130
See application file for complete search history.

(56) References Cited

U.S. PATENT DOCUMENTS

| | | | | |
|---|---|---|---|---|
| 4,931,108 | A | 6/1990 | Anzawa et al. | 148/18 |
| 6,228,188 | B1 | 5/2001 | Meersschaut et al. | 148/595 |

(Continued)

FOREIGN PATENT DOCUMENTS

| | | | | |
|---|---|---|---|---|
| CA | 1 270 427 | 6/1990 | ..... | C21D 9/567 |
| DE | 28 15 090 | 10/1978 | ..... | C21D 9/52 |

(Continued)

OTHER PUBLICATIONS

AISE and SAE Standard Gradesand Ranges, copyright Mar. 1980, pp. 25-42, Modern Steels and Their Properties, Handbook 3310, Bethlehem Steel Corp., Bethlehem, PA, US.

(Continued)

*Primary Examiner* — Scott Kastler
(74) *Attorney, Agent, or Firm* — MacCord Mason PLLC

(57) ABSTRACT

A cooling unit, a heating-cooling operation including a cooling unit, a rod or wire manufacturing system, a method for manufacturing a rod or wire, a method for heat treating of a rod or wire, a method for treating metal, a steel rod or steel wire, and a treated metal having an improved tensile strength are disclosed. The cooling unit includes at least one adaptable quenching zone and at least one adaptable soaking zone. The at least one adaptable quenching zone is capable of quenching to a soaking temperature. The at least one adaptable soaking zone is capable of maintaining substantially the soak temperature.

9 Claims, 12 Drawing Sheets

(51) Int. Cl.

| | |
|---|---|
| ***C21D 1/64*** | (2006.01) |
| ***C21D 8/06*** | (2006.01) |
| ***C21D 9/54*** | (2006.01) |
| ***C21D 9/573*** | (2006.01) |
| *C21D 1/60* | (2006.01) |

(56) References Cited

U.S. PATENT DOCUMENTS

| | | | | |
|---|---|---|---|---|
| 8,506,878 | B2 | 8/2013 | Tyl | 266/112 |
| 2008/0011394 | A1 | 1/2008 | Tyl | 148/596 |
| 2009/0308503 | A1 | 12/2009 | Tyl | 148/595 |
| 2014/0159286 | A1* | 6/2014 | Tyl | 266/44 |

FOREIGN PATENT DOCUMENTS

| | | | |
|---|---|---|---|
| EP | 0 126 481 | 5/1984 | C21D 9/573 |
| EP | 0 524 689 | 7/1992 | C21D 9/52 |
| JP | 54161507 | 12/1979 | C21D 1/00 |
| JP | S57-110623 | 7/1982 | C21D 9/52 |
| JP | 59232237 | 12/1984 | C21D 1/63 |
| JP | 60248824 | 12/1985 | C21D 1/56 |
| JP | 61106726 | 5/1986 | C21D 9/52 |
| JP | 61-276938 | 12/1986 | C21D 9/567 |
| JP | 63250421 | 10/1988 | C21D 9/52 |
| JP | 06-063637 | 3/1994 | C21D 9/52 |
| JP | 6063637 | 3/1994 | B21B 45/02 |
| JP | 6226325 | 8/1994 | B21B 45/02 |
| JP | 6226326 | 8/1994 | B21B 45/02 |
| JP | 6228656 | 8/1994 | C21D 9/52 |
| JP | 6264150 | 9/1994 | B21B 43/00 |
| JP | 8099114 | 4/1996 | B21B 45/02 |
| WO | WO2008/009009 | 1/2008 | |

OTHER PUBLICATIONS

Carbon and Alloy Steels, copyright Mar. 1980, pp. 19-23, Modern Steels and Their Properties, Handbook 3310, Bethlehem Steel Corp., Bethlehem, PA US.

Carbon Steel Water-and Oil-Hardening Grades, copyright Mar. 1980, pp. 93-111, Modern Steels and Their Properties, Handbook 3310, Bethlehem Steel Corp., Bethlehem, PA US.

Glossary of Steel Testing and Thermal Treating Terms, copyright Mar. 1980, pp. 191-198, Modern Steels and Their Properties, Handbook 3310, Bethlehem Steel Corp., Bethlehem, PA US.

Hardenability of Carbon and Alloy Steels, copyright 1985, pp. 4-58-4-63, Metals Handbook Desk Edition, American Society for Metals, Metals Park, OH, US.

Heat Treating of Steel, copyright 1985, pp. 28-11-28-21, Metals Handbook Desk Edition, American Society for Metals, Metals Park, OH, US.

High-Strength Steels, copyright 1985, pp. 4-50-4-58, Metals Handbook Desk Edition, American Society for Metals, Metals Park, OH, US.

Krauss, George, HeatTreating—Physical Metallurgy and the Heat Treatment of Steel, copyright 1985, pp. 28-1-28-10, Metals Handbook Desk Ed., American Soc. for Metals, Metals Park, OH, US.

Mechanical Properties of Carbon and Alloy Steels, copyright Mar. 1980, pp. 84-85, Modern Steels and Their Properties, Handbook 3310, Bethlehem Steel Corp., Bethlehem, PA, US.

Mitchell, Conrad, ed., Carbon and Alloy Steels—Classifications and Designations of Carbon and Alloy Steels, 1985, pp. 4-1-4-23, Metals Handbook Desk Ed., American Soc. for Metals, Metals Park, OH, US.

Steel Bar, Rod and Wire, 1985, pp. 4-30-4-39, Metals Handbook Desk Ed., American Soc. for Metals, Metals Park, OH, US.

vander Voort, George F., Typical Microstructures of Iron-Base Alloys, 1985, pp. 35-37-35-47, Metals Handbook Desk Ed., American Soc. for Metals, Metals Park, OH, US.

Krauss, George, Processing, Structure and Performance, Steels, Chapter 4, American Soc. for Metals, Metals Park, OH, US; copyright 2005.

Krauss, George, Processing, Structure and Performance, Steels, Chapter 10, American Soc. for Metals, Metals Park, OH, US; copyright 2005.

Krauss, George, Processing, Structure and Performance, Steels, Chapter 15, American Soc. for Metals, Metals Park, OH, US; copyright 2005.

* cited by examiner

ROD OR WIRE MANUFACTURING SYSTEM, RELATED METHODS, AND RELATED PRODUCTS

PRIORITY APPLICATIONS

This application claims the benefit of U.S. patent application Ser. No. 12/373,872 filed Jan. 14, 2009, now U.S. Pat. No. 8,506,878, which claims priority of PCT Application No. US2007/073549 filed Jul. 14, 2007, which in turn, is a continuation in part of U.S. patent application Ser. No. 11/487,004 filed Jul. 14, 2006 now abandoned.

FIELD OF THE INVENTION

The present invention relates to a rod or wire manufacturing system including at least one heating-cooling unit. Also, the present invention relates to a method for manufacturing a rod or wire including heating and subsequently cooling the rod or wire. Further, the present invention relates to the products resulting from the use of a rod or wire manufacturing system and/or a method for manufacturing a rod or wire including heating and subsequently cooling the rod or wire.

BACKGROUND

Drawn rod or wires for industrial purposes can be made from a variety of metals or alloys including without limitation aluminum, copper, alloy steels, and carbon steels. When made using a carbon steel, the carbon content can range from about 0.35 to 1.1% by weight. Carbon steel may also contain alloying elements such as chromium (Cr), boron (B), silicon (Si) or combinations of these elements.

Before drawing, a material is usually subjected to a heat treatment known as annealing. For carbon steel, the heat treatment consists of passing a rod or wire through a heat source such as a furnace to heat the rod or wire to about 930° C. to 1020° C. This high temperature treatment produces a uniform face centered cubic austenite phase with a regulated grain size to help determine the product's subsequent ductility. Subsequent cooling in air or more commonly in molten lead or fluidized sand produces a phase transformation from face centered cubic austenite to body centered cubic ferrite and orthorhombic cementite arranged in alternating plates, jointly called pearlite. This transformation is rapid since the sections treated are relatively small (generally less than 3.5 mm). The resulting structure consists of very fine pearlite preferably with no grain boundary ferrite or cementite. The fineness of the pearlite depends on the product chemistry and the temperature to which the product is reduced after austenitizing. As annealed, fine pearlite rod or wire is able to be drawn to reductions of area up to and sometimes exceeding 97%, resulting in very high drawn filament strengths. The final drawn filament strength provides exceptional fatigue resistance due to the very fine pearlite size, superior surface quality and the alignment of cementite plates in the drawn direction.

Heat processing metal objects by a fluidized bed is known where the temperature of a solid medium, such as sand suspended in a gas is used to regulate the rate of heat transfer. The rate of heat transferred to the surrounding media per unit surface area of the rod or wire is determined by the temperature of the media since the convective heat transfer coefficient is constant for the media chosen.

Heat processing metal objects by means of a liquid lead bath or media is also known where the temperature of the liquid lead is used to regulate the rate of heat transfer. The rate of heat transferred to the surrounding media per unit surface area of the wire is determined by the temperature of the media.

Heat processing metal objects by means of air is also known where the temperature and velocity of the air is used to regulate the rate of heat transfer.

However, once the physical characteristics of fluidized sand or molten lead baths are set, the flexibility of the heat treating process becomes limited. When processing strand products of different chemistries, like SAE 1070 and SAE 1090 steels requiring different quenching temperatures, it is not possible to accommodate both since only a single temperature can be maintained in any one quenching zone or bath.

Metal alloys such as steel alloys are produced with many different characteristics for use in different industries for different purposes. In recent years, a large demand has developed for steel strands or wires for use in industrial applications such as vehicle tires, bridge strands, pre-stressed strands, galvanized drawn wire, music wire, saw wire and other products to improve their durability and strength. For vehicle use, such tires are generally referred to as steel belted radials, which are realized as stronger and last much longer than conventional, non-belted tires.

Various companies manufacture tire wire cord for use by tire manufacturers which are generally supplied on spools and designate standard alloys of SAE 1070, 1080, 1090, and non-standard alloys designated 1090Cr, 1090B, 1090CrB, and 1080SiCr with a breaking load commensurate with the type of steel used and the total amount of area reduction during final drawing.

After prolonged use, it is not uncommon for some of the wires in steel belted tires to wear, fatigue, and break. Tire manufacturers and suppliers have sought to improve the quality of steel belted tires by changing their manufacturing techniques and testing other, more expensive steel compounds, wire diameters and the like with varying results.

In view of the foregoing, it would be highly desirable to provide a new and improved rod or wire manufacturing system, a new and improved heating-cooling operation, a new and improved cooling unit, a new and improved method for manufacturing a rod or wire, and/or a new and improved rod or wire while addressing the above described shortfalls of the art systems.

A SUMMARY OF THE INVENTION

The present invention meets these and other needs by providing any one of a cooling unit, a heating-cooling operation including a cooling unit, a rod or wire manufacturing system, a method for manufacturing a rod or wire, a method for heat treating of a rod or wire, a method for treating metal, a steel rod or steel wire, and/or a treated metal having an improved tensile strength. Such a cooling unit includes at least one heat transfer coefficient adaptable quenching zone and at least one heat transfer coefficient adaptable soaking zone. The at least one heat transfer coefficient adaptable quenching zone is capable of quenching to a soaking temperature at least one continuously provided rod or at least one continuously provided wire. The at least one heat transfer coefficient adaptable soaking zone is capable of maintaining substantially at the soaking temperature the at least one continuously provided rod or the at least one continuously provided wire so as to be capable of substantially completing a heat treating. In addition to the cooling unit components, a heating-cooling operation includes at least one heating unit. Such heating unit is capable of heating to a preselected temperature at least one continuously provided rod or the at least one continuously provided wire. When as a stand alone operation, a heating-cooling operation also includes at least one feed unit and at least one take-up unit. The at least one feed unit is capable of continuously providing at least one rod or at least one wire. The at least one take-up unit is capable of continuously gathering the at least one heat treated rod or the at least one heat treated wire.

One aspect of the present invention is to provide a cooling unit or a heating-cooling operation including a cooling unit both useable with a rod or wire manufacturing system. Such a cooling unit includes at least one heat transfer coefficient adaptable quenching zone and at least one heat transfer coefficient adaptable soaking zone. The at least one heat transfer coefficient adaptable quenching zone is capable of quenching to a soaking temperature at least one continuously provided rod or at least one continuously provided wire. The at least one heat transfer coefficient adaptable soaking zone is capable of maintaining substantially at the soaking temperature the at least one continuously provided rod or the at least one continuously provided wire so as to be capable of substantially completing a heat treating. In addition to the cooling unit components, a heating-cooling operation includes at least one heating unit. Such heating unit is capable of heating to a preselected temperature at least one continuously provided rod or the at least one continuously provided wire. When as a stand alone operation, a heating-cooling operation also includes at least one feed unit and at least one take-up unit. The at least one feed unit is capable of continuously providing at least one rod or at least one wire. The at least one take-up unit is capable of continuously gathering the at least one heat treated rod or the at least one heat treated wire.

Another aspect of the present invention is to provide a rod or wire manufacturing system that includes at least one feed unit, at least one heating unit, at least one cooling unit, and at least one take-up unit. The at least one feed unit is capable of continuously providing at least one rod or at least one wire. The at least one heating unit is capable of heating to a preselected temperature the at least one continuously provided rod or the at least one continuously provided wire. The at least one cooling unit downstream of at least one heating unit includes at least one adaptable quenching zone and at least one adaptable soaking zone. In turn, the at least one adaptable quenching zone is capable of quenching to a preselected soak temperature the at least one continuously provided rod or the at least one continuously provided wire. Similarly, the at least one adaptable soaking zone is capable of substantially maintaining at the preselected soak temperature the at least one continuously provided rod or the at least one continuously provided wire. In this manner, the at least one adaptable soaking zone facilitates a substantially complete heat treatment of the at least one continuously provided rod or the at least one continuously provided wire. The at least one take-up unit is capable of continuously gathering the at least one heat treated rod or the at least one heat treated wire.

Still another aspect of the present invention is to provide a method for manufacturing a rod or wire. Such method includes steps of providing, heating, quenching, substantially maintaining at a preselected temperature, and gathering at least one rod or at least one wire. The providing can be a continuous providing of at least one rod or at least one wire. The heating includes heating the at least one continuously provided rod or the at least one continuously provided wire to a preselected temperature. The quenching includes cooling the at least one continuously provided rod or the at least one continuously provided wire to a preselected soak temperature. The substantially maintaining at the preselected soak temperature can be achieved by providing at least a foaming liquid quenchant so as to substantially complete a heat treatment of the at least one continuously provided rod or the at least one continuously provided wire may be achievable. The gathering can be a continuous gathering of the at least one heat treated rod or the at least one heat treated wire.

An additional aspect of the present invention is to provide a method for heat treating of a rod or wire. Such heat treating includes heating, quenching, and soaking. The heating includes a heating to a preselected temperature at least one continuously provided rod or at least one continuously provided wire. The quenching includes quenching to a soaking temperature the at least one continuously provided rod or the at least one continuously provided wire. The soaking includes providing at least a foaming liquid quenchant to substantially maintain at the soaking temperature the at least one continuously provided rod or the at least one continuously provided wire so as to be capable of substantially completing a heat treating.

Another additional aspect of the present invention is to provide a method for treating metal. The method includes heating, subjecting to at least one quenchant, controlling, and removing. The heating includes heating the metal. The subjecting includes subjecting the heated metal to at least one quenchant comprising a liquid and a gas or gaseous media mixture. The controlling includes controlling the at least one liquid/gas or gaseous media mixture. The removing includes removing the treated metal from the quenchant.

Still another additional aspect of the present invention is to provide a steel rod or steel wire comprising at least about 39 area percent fine pearlite. In another aspect, such a steel rod or steel wire includes up to about 45 area percent fine pearlite.

An alternative aspect of the present invention is to provide a treated metal having an improved tensile strength. Such metal can be formed by heating, guiding to at least one liquid and gas or gaseous media mixture, and removing. The heating includes heating a metal to a selected temperature. The guiding includes guiding the heated metal into at least one liquid and gas or gaseous media mixture to treat the metal. The removing includes removing the treated metal from the at least one liquid and or gaseous media mixture.

These and other aspects, advantages, and salient features of the present invention will become apparent from the following detailed description, the accompanying drawings, and the appended claims.

A BRIEF DESCRIPTION OF DRAWINGS

A DETAILED DESCRIPTION OF THE INVENTION

Figure 1A:
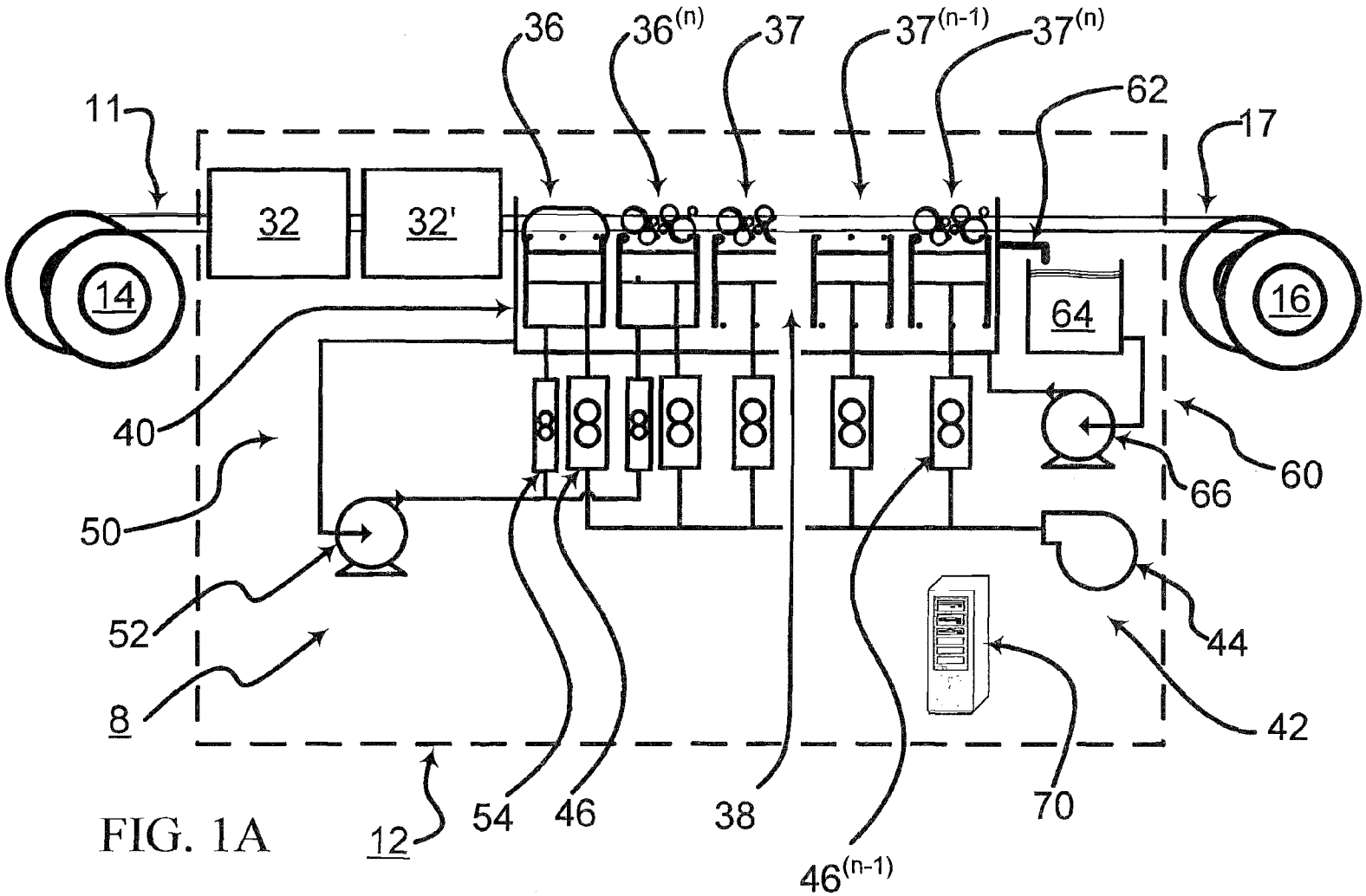
FIG. 1A depicts a side-view schematic diagram of a cooling unit including heating units according to an aspect of an embodiment of the present invention and usable with the rod or wire manufacturing system of FIG. 2.

In the following description, like reference characters designate like or corresponding parts throughout the several views shown in the figures. It is also understood that terms such as "top," "bottom," "outward," "inward," and the like are words of convenience and are not to be construed as limiting terms.

Figure 1B:
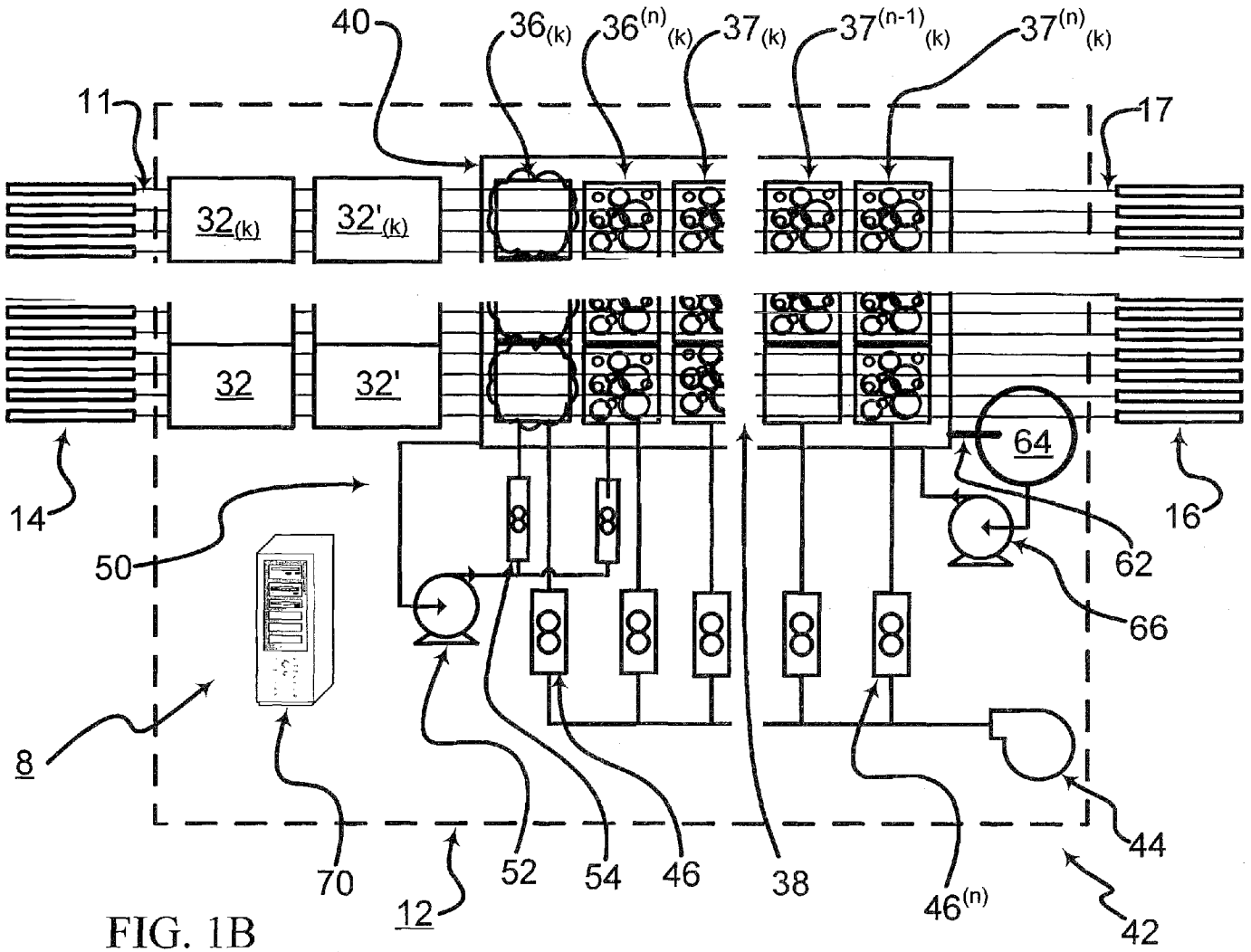
FIG. 1B depicts a plan-view schematic diagram of the cooling unit of FIG. 1A.
Figure 1C:
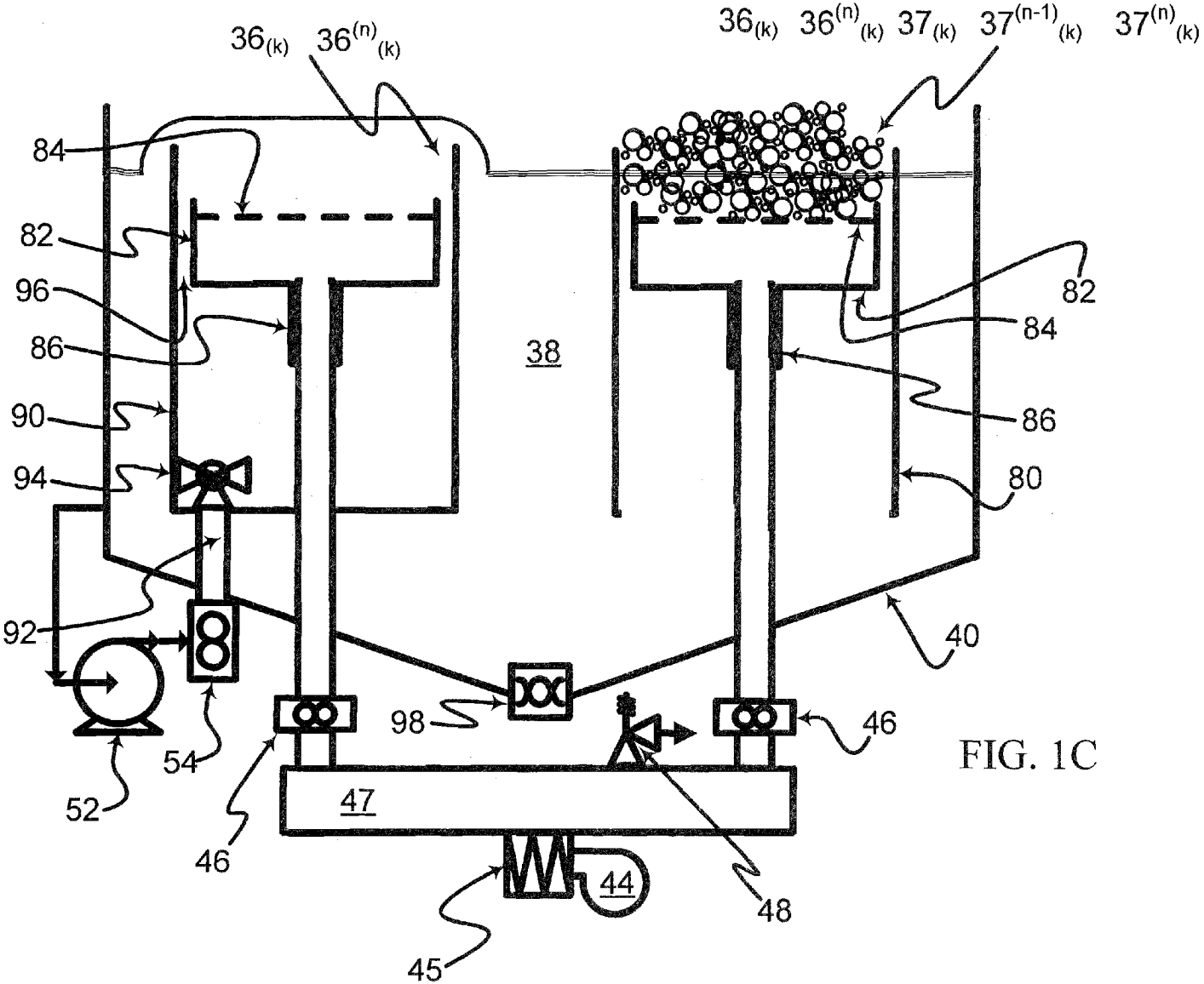
FIG. 1C depicts a section-view schematic diagram of the details of a cooling unit according to an aspect of an embodiment of the present invention and usable with the rod or wire manufacturing system of FIG. 2.
Figure 2:
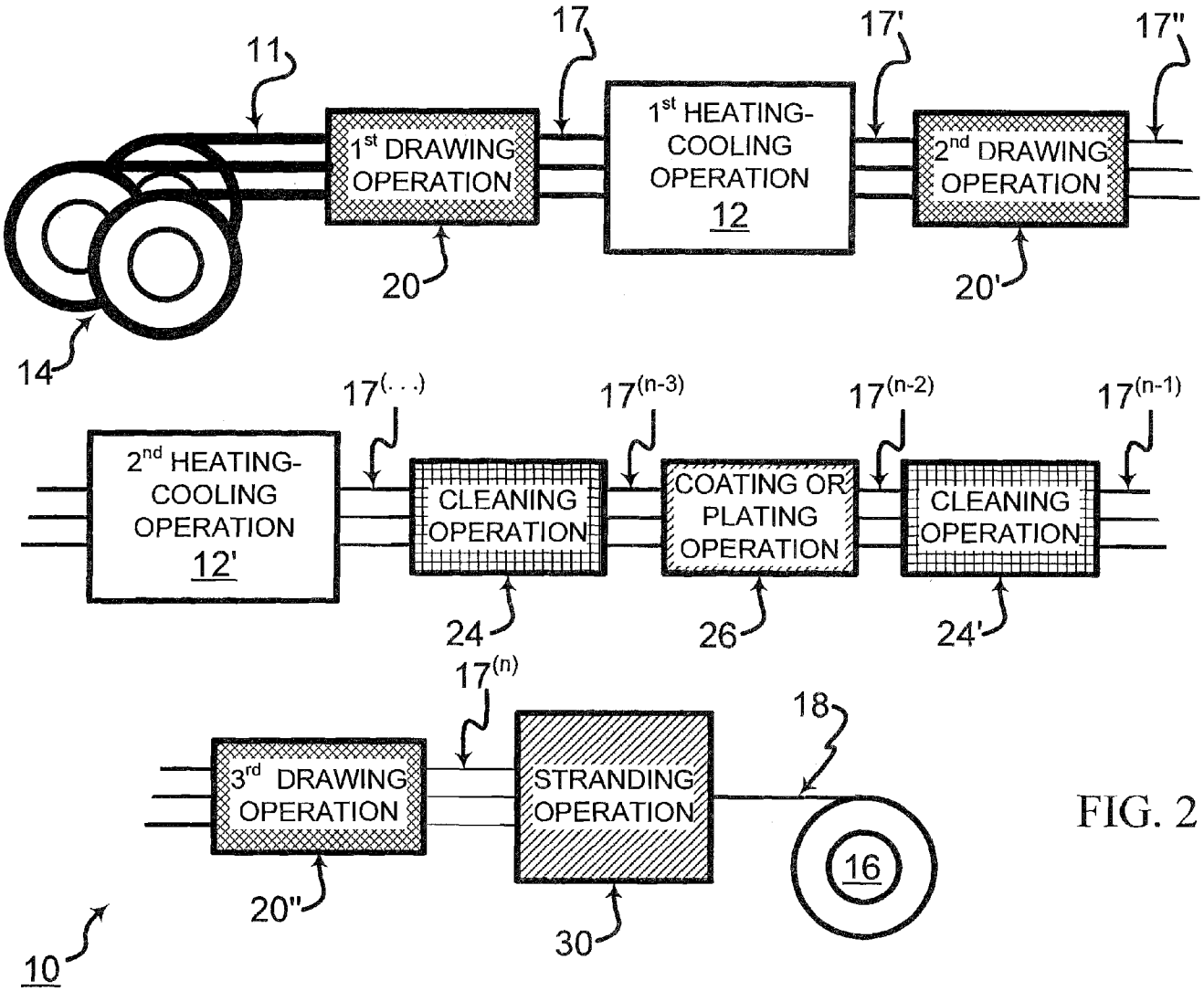
FIG. 2 depicts a side-view schematic diagram of a rod or wire manufacturing system according to an aspect of an embodiment of the present invention.

Referring now to the drawings in general, and FIGS. 1A, 1B, 1C, and 2 in particular, it will be understood that the illustrations are for the purpose of describing one or more aspects and/or embodiments of the invention and are not intended to limit the invention thereto. As best seen in FIG. 2, a rod or wire manufacturing system, generally designated 10, is shown constructed according to the present invention. A rod or wire manufacturing system 10 includes at least one feed unit 14, at least one heating-cooling operation 12, and at least one take-up unit 16. It will be appreciated that a rod or wire manufacturing system 10 may include other components, such as, one or more drawing units 20, 20', and 20", one or more cleaning units 24 and 24", one or more coating units 26, and one or more finishing or combining units, such as one or more stranding units 30. Further, it will be appreciated that a rod or wire manufacturing system 10 might include some of the components depicted in FIG. 2, all of the components depicted in FIG. 2, components in addition to those depicted in FIG. 2, or any combination thereof. As would be appreciated, FIGS. 1A, 1B, 1C, and 2 do not fully demonstrate all of the mechanical, electrical and/or other components as used herein. For example, one or more drawing units 20, 20', and 20", one or more cleaning units 24 and 24", one or more coating units 26, and one or more finishing or combining units, such as one or more stranding units 30 can be conventional in the trade and can vary in size, shape and efficiency depending on their particular requirements.

A rod or wire manufacturing system 10 as depicted in FIG. 2 in operation using feed unit 14 provides one or more rods or wires 11 while a take-up unit 16 gathers one or more intermediate or finished products 18 that, in an aspect of an embodiment of the present invention, may be one or more heat treated rods or wires 11. Between units 14 and 16, the one or more rods or wires 11 can be run, for example, through a first drawing unit 20 to provide an intermediate product 17. Such intermediate product 17 can be subjected to a first heating-cooling operation 12 so as to anneal and quench the intermediate product 17 in turn resulting in an other intermediate product 17'. This other intermediate product 17' can then be run through a second drawing operation 20' to provide intermediate product 17". It will be appreciated that each unit performing one or more operations can result in one or more intermediate products 17, 17', 17", . . . 17$^{(n)}$, 17$^{(n-1)}$.

As noted, at an end of a rod or wire manufacturing system 10 a take-up unit 16 gathers one or more intermediate or finished products 18 that might be used individually as a feedstock in a further manufacturing process or, alternatively, brought together or combined in one or more operations, such as by using a stranding unit 30 as depicted in FIG. 2, to create an intermediate or finished product 18 to be used in a brought together or combined form as a feedstock in a further manufacturing process. To that end, intermediate or finished product 18 can include, be used as, or be included in, without limitation, any one of wire (e.g., fencing wire; livestock wire including without limitation wire for cattle fencing, sheep fencing, horse fencing, rabbit proof fencing, . . . etc; horticultural wire including without limitation trellising; aquaculture wire including without limitation marine mesh cages; bright wire; galvanized wire; chainmesh wire; mechanical spring wire; nail wire; concrete reinforcing wire . . . etc.); rod and/or bar (e.g., coiled rod, straight rod, rounds, squares, hexagons, deformed bar, flats, light structural . . . etc.); reinforcing (e.g., mesh bar, reinforcing bar, mining mesh, industrial mesh, rural mesh . . . etc.); steel in concrete (e.g., roads, bridges, tunnels, houses, residential buildings, warehouses, shopping centers, factories, accessories, concrete pipes, railway sleepers . . . etc.); mining (e.g., dragline ropes, shovel ropes, strata control bolts, strata control mesh, cable belt, . . . etc.); manufacturing (e.g., spring manufacturing including without limitation rail clips, general springs, mattress coils and/or springs, . . . etc., welding including without limitation welding electrodes and/or welding wire, fabrication including without limitation screens, grating, and sheds; fasteners including without limitation nails and other fasteners, automotive including without limitation springs, tire cord, tire bead wire, other steel tire reinforcement, bright bar . . . etc.; . . . etc.).

FIGS. 1A and 1B depicted a heating-cooling operation 12, in plan view and top view respectfully, according to an aspect of the present invention. As with FIG. 2, FIGS. 1A and 1B depicted a feed unit 14 that provides one or more rods or wires 11 to one or more heating units 32, 32' to heat the one or more rods or wires 11 to a preselected temperature. After the one or more rods or wires 11 are heated to a preselected temperature, they are provided to a cooling unit 8 that includes one or more adaptable quenching zones 36, . . . , 36$^{(n-1)}$ and one or more adaptable soaking zones 37, . . . , 37$^{(n-1)}$, 37$^{(n)}$.

As the one or more heated rods or wires 11 exit the heating unit 32' as depicted in FIGS. 1A and 1B, they can enter one or more adaptable quenching zones 36, 36$^{(n-1)}$. FIGS. 1A, 1B, and 1C depict second cell type 90 within a quenchant reservoir 40, according to an aspect of an embodiment of the present invention, for use as one or more adaptable quenching zones 36, 36$^{(n-1)}$. FIG. 1C depicts further details about a second cell type 90. For example, second cell type 90 can be capable of providing a quenchant, for example, as a liquid welling up above the upper level of the second cell type 90. A flow of the liquid quenchant 38 can be controlled by a second heat transfer adjuster 50 that includes a liquid quenchant supplier 52, such as a pump, and an adjusting mechanism 54, such as a valve, a flow meter, or a valve in combination with a flow meter.

Applicant has found that a flow rate of liquid quenchant 38 to a second cell type 90 of adaptable quenching zones 36, 36$^{(n-1)}$ can be adjusted to tailor a heat transfer coefficient between the liquid quenchant 38 and the one or more rods or wires 11 traveling through the welling liquid quenchant 38. In particular, Applicant has found that the flow rate of the liquid quenchant 38 interacting with a rod or wire 11 can affect the heat transfer coefficient at the wire quenchant interface. Applicant believes that as the flow rate of quenchant is increased, the tendency to form a boiling film (also referred to as film boiling or film water cooling) at a rod or wire 11/liquid quenchant 38 interface can be decreased to create a more intimate contact between the traveling rod or wire 11 and the liquid quenchant 38 and thus increase a heat transfer coefficient at such interface.

In addition to tailoring the heat transfer coefficient to adjust the rate of heat removal from a traveling rod or wire 11, it will be appreciated that the rate of heat removal can be adjusted by changing a composition of a liquid quenchant 38 to create a smaller or larger heat transfer coefficient and, in turn, smaller or larger rate of heat removal.

In addition to tailoring the heat transfer coefficient to adjust the rate of heat removal from a traveling rod or wire 11, it will be appreciated that the rate of heat removal can be adjusted by preselecting a temperature of the liquid quenchant 38 to create a smaller or larger temperature difference and, in turn, smaller or larger temperature gradient. In this manner, adaptable quenching zones 36, $\mathbf{36}^{(n-1)}$ according to an aspect of an embodiment of the present invention can provide one or more adjustable quenching zones 36, $\mathbf{36}^{(n-1)}$ having a capability of a tailorable heat removal rate that can be substantially continuously tailored through an independent manipulation of a heat transfer coefficient or a liquid quenchant 38 temperature, or through a combined manipulation of a heat transfer coefficient and a liquid quenchant 38 temperature.

Alternatively, one or more adaptable quenching zones 36, $\mathbf{36}^{(n-1)}$ can use a second cell type 90 capable of providing a quenchant, for example, a foam (e.g., formed by trapping many gas bubbles in a liquid quenchant 38), above an upper level of the second cell type 90. An amount of gas that becomes entrapped in liquid quenchant 38 as bubbles can be controlled by a first heat transfer adjuster 42 that includes a gaseous media supply 44, such as a blower or compressed gas source, and an adjusting mechanism 46, such as a valve, a flow meter, or valve in combination with a flow meter, in communication with a diffuser 82 including a porous media 84 submerged in a quenchant 38. Further details of heat transfer adjuster 42 communicating with a second cell type 90 are depicted in FIG. 1C and can include a gaseous media cleaner 45 for cleaning a gas provided by the gaseous media supply 44, pressure equalizer 47 and a pressure regulator 48 that together allow a preselected gas volume to be provided a diffuser 82 at a preselected pressure so as to tailor a foam composition (e.g., an amount gas entrapped as bubbles in liquid quenchant 38 to create a foam) and/or volume to attain a preselected rate of heat transfer.

Further features of a second cell type 90 are depicted in FIG. 1C and include an ability to provide liquid quenchant 38 through quenchant supplier 52 at an appropriate volume and pressure to well up a liquid quenchant 38 above the upper level of the second cell type 90 and an ability to provide liquid quenchant 38 from quenchant reservoir 40 and by passing quenchant supplier 52 when a liquid quenchant 38 is provided as a foam up above the upper level of the second cell type 90. In an aspect of an embodiment of the present invention, such flexibility can be achieved through a use of a mechanism or selector 94 (such as a three-way valve as depicted in FIG. 1C) that is capable of isolating the volume of the second cell type 90 from quenchant reservoir 40 while receiving liquid quenchant 38 from quenchant supplier 52. Alternatively, such mechanism or selector 94 (such as a three-way valve as depicted in FIG. 1C) is capable of allowing the volume of the second cell type 90 to communicate with and receive liquid quenchant 38 from quenchant reservoir 40 when a liquid quenchant 38 is provided as a foam. Also, Applicant has found that it is desirable for area 96 (e.g., defined by the space between the walls of second cell type 90 and the walls of the diffuser 82) to be at least twice the cross-sectional area of the supply line 92 so that an appropriate liquid quenchant 38 flow rate is achievable.

After one or more rods or wires 11 have traveled through the one or more adaptable quenching zones 36, $\mathbf{36}^{(n-1)}$, the one or more rods or wires 11 then travel through one or more adaptable soaking zones 37, . . . $\mathbf{37}^{(n-1)}$, $\mathbf{37}^{(n)}$. FIGS. 1A, 1B, and 1C depict first cell type 80 within a quenchant reservoir 40, according to another aspect of an embodiment of the present invention, for use as one or more adaptable soaking zones 37, . . . $\mathbf{37}^{(n-1)}$, $\mathbf{37}^{(n)}$. FIG. 1C depicts further details about a first cell type 80. For example, first cell type 80 can be capable of providing a quenchant, for example, as a foam (e.g., formed by trapping many gas bubbles in a liquid quenchant 38) above an upper level of the first cell type 80. An amount of gas that becomes entrapped in liquid quenchant 38 as bubbles can be controlled by a first heat transfer adjuster 42 that includes a gaseous media supply 44, such as a blower or compressed gas source, and an adjusting mechanism 46, such as a valve, a flow meter, or valve in combination with a flow meter, in communication with a diffuser 82 including a porous media 84 submerged in a quenchant 38. Further details of heat transfer adjuster 42 communicating with a first cell type 80 are depicted in FIG. 1C and can include a gaseous media cleaner 45 for cleaning a gas provided by the gaseous media supply 44, pressure equalizer 47 and a pressure regulator 48 that together allow a preselected gas volume to be provided a diffuser 82 at a preselected pressure so as to tailor a foam composition (e.g., an amount of gas entrapped as bubbles in liquid quenchant 38 to create a foam) and/or volume to attain a preselected rate of heat transfer.

Applicant has found that a flow rate of gas to a first cell type 80 of adaptable soaking zones 37, . . . $\mathbf{37}^{(n-1)}$, $\mathbf{37}^{(n)}$ can be adjusted to tailor a heat transfer coefficient between a foaming quenchant and the one or more rods or wires 11 traveling through the foaming quenchant. In particular, Applicant has found that the flow rate of gas used to create foaming quenchant interacting with a rod or wire 11 can affect the heat transfer coefficient. Applicant has found that as the flow rate of gas used to create a foaming quenchant is increased, there is a tendency to decrease the amount of intimate contact between the traveling rod or wire 11 and a liquid quenchant 38 of the foam. Thus, there is a decrease in the rate of heat transfer.

In addition to tailoring the heat transfer coefficient to adjust the rate of heat removal from a traveling rod or wire 11, it will be appreciated that the rate of heat removal can be adjusted by changing a composition of a liquid quenchant 38 to create a smaller or larger heat transfer coefficient and, in turn, smaller or larger rate of heat removal.

In addition to tailoring the heat transfer coefficient to adjust the rate of heat removal from a traveling rod or wire 11, it will be appreciated that the rate of heat removal can be adjusted by preselecting a temperature of the liquid quenchant 38 used to create foaming quenchant. In this manner, when adaptable soaking zones 37, . . . $\mathbf{37}^{(n-1)}$, $\mathbf{37}^{(n)}$ include a quenchant reservoir 40 independent of each other and/or of adaptable quenching zones 36, $\mathbf{36}^{(n-1)}$ according to an aspect of an embodiment of the present invention, one can provide one or more adaptable soaking zones 37, . . . $\mathbf{37}^{(n-1)}$, $\mathbf{37}^{(n)}$ having a capability of a tailorable heat removal rate that can be substantially continuously tailored through an independent manipulation of a heat transfer coefficient or a liquid quenchant 38 temperature, or a composition of a liquid quenchant 38, or through a combined manipulation of any combination of any of the preceding (e.g., manipulation of a heat transfer coefficient and a liquid quenchant 38 temperature; manipulation of a composition of a liquid quenchant 38 and a liquid quenchant 38 temperature; manipulation of a heat transfer coefficient and a composition of a liquid quenchant 38; manipulation of a heat transfer coefficient, a liquid quenchant 38 temperature; and a composition of a liquid quenchant 38).

Further features of a second cell type 90 and a first cell type 80 are depicted in FIG. 1C and include a capability of removably attaching diffuser 82 by a use of socket 86 to accommodate an ease of providing and/or replacing diffuser 82 to either cell type 80, 90. Although not depicted, it will be appreciated that socket 86 can be created by providing one or more detents for accommodating one or more seal materials (e.g., o-rings) in either its inner perimeter or its outer perimeter. In the case of one or more outer perimeter detents, after placement of the one or more seal materials (e.g., o-rings), a conduit having an inner perimeter substantially matching the outer perimeter can be engaged with the socket 86. In the case of one or more inner perimeter detents, after placement of the one or more seal materials (e.g., o-rings), a conduit having an outer perimeter substantially matching the inner perimeter can be engaged with the socket 86. It will be appreciated that the one or more detent might be formed in a perimeter rather than in the socket 86.

As to a diffuser 82 in a second cell type 90 and a first cell type 80, it may be of any design that is capable of providing a volume of gas in a manner that results in an entrapment of gas bubbles in a liquid quenchant 38 to create a foaming quenchant. To that end, Applicant has found that porous media 84 such as that commercially available from Purolator EFP (having locations in Tulsa, Okla.; Houston, Tex.; Shelby, N.C.; St. Catharines, Ontario, Canada; and Dalton, Ga.) and sold as POROPLATE® sintered laminate screen packs to work. Also, Applicant has found that the outer surface of porous media 84 of diffuser 82 can be submerged in quenchant reservoir 40 an amount that is substantially just below the surface of liquid quenchant 38 of quenchant reservoir 40. In turn, Applicant has found that a pressure, for example, in pressure equalizer 47 and/or pressure regulator 48 is sufficient if it is just slightly greater than the height of liquid quenchant 38 above the outer surface of porous media 84 of diffuser 82. Further, Applicant has found that an entrapment of gas in liquid quenchant 38 in creating a foaming quenchant can create such a recirculation of liquid quenchant 38 within quenchant reservoir 40 so that the temperature of the liquid quenchant 38 can be substantially homogeneous throughout.

As to a liquid quenchant 38 of quenchant reservoir 40, it can be any liquid or liquid mixture that permits the one or more adaptable quenching zones 36, $\mathbf{36}^{(n-1)}$ and/or the one or more adaptable soaking zones 37, . . . $\mathbf{37}^{(n-1)}$, $\mathbf{37}^{(n)}$ to each function for their intended purpose. Also with reference to FIGS. 1A, 1B, and 1C, a liquid quenchant 38 can be any liquid or liquid mixture that permits the one or more second cell types 90 of the one or more adaptable quenching zones 36, $\mathbf{36}^{(n-1)}$ and/or the one or more first cell types 80 one or more adaptable soaking zones 37, . . . $\mathbf{37}^{(n-1)}$, $\mathbf{37}^{(n)}$ to each function for its intended purpose. To that end Applicant has found that water or water mixed with either a RAQ-TWT quenching solution or RAQ-TWT-2 quenching solution sold by Richards Apex, Inc. of Philadelphia, Pa. is capable of working. RAQ-TWT quenching solution is a proprietary formula containing: polyalkylene glycol—about 45.5%; polyethylene glycol ester—about 12%, a proprietary metal working fluid additive—about 12%, a defoamer—about 0.5%, and water—about 30%, with a typical pH of about 3-9%. RAQ-TWT-2 quenching solution is substantially the same as RAQ-TWT-2 quenching solution but without the defoamer. These quenchant solutions can be diluted to up to about 90% by volume or more with water prior to use. Measured characteristics for each quenchant solution when added at a concentration of about 1% to water are summarized in Tables 1 and 2 below. It will be appreciated that other commercial quenching liquids or water can also or instead be used.

TABLE 1

RAQ-TWT-2 quenching solution

| Property | Unit | Test 1 | Test 2 | Test 3 | Average |
|---|---|---|---|---|---|
| Maximum Cooling Rate | ° C./s | 200.68 | 199.90 | 195.27 | 198.62 |
| Temp. at Max. Cooling Rate | ° C. | 601.56 | 603.13 | 609.04 | 604.58 |
| Temp. at Start of Boiling | ° C. | 813.25 | 812.93 | 814.77 | 813.65 |
| Temp. at Start of Convection | ° C. | 147.83 | 145.17 | 149.71 | 147.57 |
| Cooling Rate at 300° C. | ° C./s | 93.23 | 94.50 | 87.07 | 91.60 |
| Time to 600° C. | s | 4.65 | 4.38 | 4.59 | 4.54 |
| Time to 400° C. | s | 5.66 | 5.42 | 5.85 | 5.64 |
| Time to 200° C. | s | 8.22 | 7.97 | 8.38 | 8.19 |
| Theta 1 | ° C. | 812.15 | 811.37 | 813.87 | 812.46 |
| Theta 2 | ° C. | 213.85 | 216.00 | 231.20 | 220.35 |

TABLE 2

RAQ-TWT quenching solution

| Property | Unit | Test 1 | Test 2 | Test 3 | Average |
|---|---|---|---|---|---|
| Maximum Cooling Rate | ° C./s | 174.91 | 186.92 | 179.70 | 180.51 |
| Temp. at Max. Cooling Rate | ° C. | 545.39 | 539.28 | 550.53 | 545.07 |
| Temp. at Start of Boiling | ° C. | 781.31 | 766.55 | 773.97 | 773.94 |
| Temp. at Start of Convection | ° C. | 90.21 | 106.73 | 86.16 | 94.37 |
| Cooling Rate at 300° C. | ° C./s | 85.04 | 85.81 | 85.88 | 85.58 |
| Time to 600° C. | s | 7.22 | 7.64 | 7.39 | 7.42 |
| Time to 400° C. | s | 8.54 | 8.72 | 8.78 | 8.68 |
| Time to 200° C. | s | 10.71 | 10.98 | 10.98 | 10.89 |
| Theta 1 | ° C. | 778.68 | 762.52 | 769.61 | 770.27 |
| Theta 2 | ° C. | 185.35 | 183.49 | 183.54 | 184.13 |

Another aspect of a quenchant reservoir 40 of cooling system 8 is a quenchant level control 60 that can include a quenchant level setter 62, a quenchant supply 64, and a quenchant resupply 66. It will be appreciated that a quenchant level control 60 may be any structure or combination of structures that are capable of maintaining a prescribed level of liquid quenchant 38 in a quenchant reservoir 40 so that the one or more adaptable quenching zones 36, $\mathbf{36}^{(n-1)}$ and the one or more adaptable soaking zones 37, . . . $\mathbf{37}^{(n-1)}$, $\mathbf{37}^{(n)}$ of cooling system 8 are capable of operating in the various modes or manners described herein. To that end, FIGS. 1A and 1B depict quenchant level setter 62 as conduit toward an upper portion of quenchant reservoir 40 to allow excess of liquid quenchant 38 to flow to quenchant supply 64. In turn, quenchant supply 64 is depicted as a tank while quenchant resupply 66 is depicted as a pump. In this manner, quenchant level setter 62 can maintain a level of liquid quenchant 38 above the one or more second cell types 90 of the one or more adaptable quenching zones 36, $\mathbf{36}^{(n-1)}$ and/or the one or more first cell types 80 one or more adaptable soaking zones 37, . . . $\mathbf{37}^{(n-1)}$, $\mathbf{37}^{(n)}$ so that each functions for its intended purpose.

According to an aspect of an embodiment of the present invention, it can be desirable to adjust a temperature of liquid quenchant 38 to be able to tailor the rate of heat transfer from the one or more rods or wire 11. To that end, it could be desirable to provide one or more temperature regulators (not depicted in FIGS. 1A, 1B, and 1C) to any one of quenchant reservoir 40, quenchant supply 64, or quenchant reservoir 40 and quenchant supply 64. According to various aspects of this embodiment, such one or more temperature regulators could include a heater, a cooler, or a heater and a cooler. Further, it will be appreciated that such one or more temperature regulators are commercially available.

According to another aspect of an embodiment of the present invention, a plurality of rods or wires 11 can be processed using either a rod or wire manufacturing system 10 as depicted in FIG. 2 including one or more heating-cooling operations 12, 12' or a heating-cooling operation 12 as depicted in FIGS. 1A and 1B. For example, bundles of wires having about 5-90 or more wires per bundle could be processed simultaneously during normal production. Other metal strand materials could likewise be treated. Advantageously, such plurality of rods or wires 11 can include a plurality of rod or wire 11 chemistries, a plurality of rod or wire 11 diameters or a plurality of rod or wire 11 chemistries and diameters. In operation, Applicant believes that rods or wires 11 having substantially the same chemistry and/or substantially the same diameters could be run as a bank. For example, FIG. 1A depicts one bank as the at least one feed unit 14 that provides one or more rods or wires 11 to one or more heating units 32, 32'; one or more adaptable quenching zones 36, $\mathbf{36}^{(n-1)}$; one or more adaptable soaking zones 37, . . . $\mathbf{37}^{(n-1)}$, $\mathbf{37}^{(n)}$; and the corresponding at least one take-up unit 16. As a further example, FIG. 1A depicts a second bank as the at least one feed unit 14 that provides one or more rods or wires 11 to one or more heating units $\mathbf{32}_{(k)}$, $\mathbf{32'}_{(k)}$; one or more adaptable quenching zones $\mathbf{36}_{(k)}$, $\mathbf{36}^{(n-1)}{}_{(k)}$; one or more adaptable soaking zones $\mathbf{37}_{(k)}$, . . . $\mathbf{37}^{(n-1)}{}_{(k)}$, $\mathbf{37}^{(n)}{}_{(k)}$; and the corresponding at least one take-up unit 16. It will be appreciated that the one or more heating-cooling operations 12, 12' of a rod or wire manufacturing system 10 as depicted in FIG. 2 or a heating-cooling operation 12 as depicted in FIGS. 1A and 1B can have such a capability as result of an independent adjustability of the one or more heating-cooling operations 12, 12'. In particular, such an independent adjustability can arise from an independent adjustability within the one or more heating-cooling operations 12, 12'. As discussed the rate of heat removal can be tailored independently for each of the one or more adaptable quenching zones 36, $\mathbf{36}^{(n-1)}$ and the one or more adaptable soaking zones 37, . . . $\mathbf{37}^{(n-1)}$, $\mathbf{37}^{(n)}$. In addition, a first number of adaptable quenching zones 36, $\mathbf{36}^{(n-1)}$ and a second number of adaptable soaking zones 37, $\mathbf{37}^{(n-1)}$, $\mathbf{37}^{(n)}$ of one bank can be prescribed to match the characteristics of a first rod or wire diameter and composition while a third number of adaptable quenching zones 36, $\mathbf{36}^{(n-1)}$ and a fourth number of adaptable soaking zones 37, . . . $\mathbf{37}^{(n-1)}$, $\mathbf{37}^{(n)}$ of another bank can be prescribed to match the characteristics of a second rod or wire diameter and composition. To that end, it will be appreciated that a cooling unit 8 has further adjustability through an ability to change a length of an adaptable quenching zones 36, $\mathbf{36}^{(n-1)}$ and/or a length of an adaptable soaking zones 37, . . . $\mathbf{37}^{(n-1)}$, $\mathbf{37}^{(n)}$.

In one aspect of an embodiment of the present invention, one or more adaptable quenching zones 36, $\mathbf{36}^{(n-1)}$ provide either a welling liquid quenchant or a foaming liquid quenchant while one or more adaptable soaking zones 37, . . . $\mathbf{37}^{(n-1)}$, $\mathbf{37}^{(n)}$ provide a foaming liquid quenchant. In another aspect of an embodiment of the present invention, one or more adaptable quenching zones 36, $\mathbf{36}^{(n-1)}$ provide a foaming liquid quenchant while one or more adaptable soaking zones 37, . . . $\mathbf{37}^{(n-1)}$, $\mathbf{37}^{(n)}$ provide a foaming liquid quenchant. In yet another aspect of an embodiment of the present invention, one or more adaptable quenching zones 36, $\mathbf{36}^{(n-1)}$ provide either a foaming liquid quenchant while one or more adaptable soaking zones 37, . . . $\mathbf{37}^{(n-)}$, $\mathbf{37}^{(n)}$ provide either a foaming liquid quenchant or a gaseous quenchant, such as air or an inert gas. In still yet another aspect of an embodiment of the present invention, one or more adaptable quenching zones 36, $\mathbf{36}^{(n-1)}$ provide either a welling liquid quenchant while some of the one or more adaptable soaking zones 37, . . . $\mathbf{37}^{(n-1)}$, $\mathbf{37}^{(n)}$ provide a foaming liquid quenchant and other of the one or more adaptable soaking zones 37, . . . $\mathbf{37}^{(n-1)}$, $\mathbf{37}^{(n)}$ provide a gaseous quenchant, such as air or an inert gas.

Other aspects of an embodiment of the present invention involve a controller 70 that is capable of communicating with one or more of the units or components of either a rod or wire manufacturing system 10 as depicted in FIG. 2 including one or more heating-cooling operations 12, 12' or a heating-cooling operations 12 as depicted in FIGS. 1A and 1B. Such controller 70, for example, can regulate a rate of rod or wire payout from the feed unit 14 and a rate of take up of intermediate or finished product 18 by take-up unit 16 and thereby having a capability to set a prescribed tension of the one or more rods or wires 11 as they travel through the heating units 32, 32', and the cooling unit 8. Also, the controller 70 can be configured to communicate with any of the variety of heat transfer adjusters 42, 50 so as to permit an adjustment of a rate of heat transfer by for example changing a heat transfer coefficient, a liquid quenchant 38 temperature, a number of adaptable quenching zones 36, $\mathbf{36}^{(n-1)}$, a number of adaptable soaking zones 37, . . . $\mathbf{37}^{(n-1)}$, $\mathbf{37}^{(n)}$, or any combination of any of the preceding as may be appropriate.

A controller 70 can be a commercially available controller with a plurality of inputs and outputs that meet the requirements of any peripherals. The controller 70 can be any one of a micro-controller, a PC with appropriate hardware and software, and combinations of one or more thereof. Details concerning controllers that may be used in rod or wire manufacturing system 10 or one or more heating-cooling operations 12, 12' are discussed in, for example, U.S. Pat. Nos. 5,980,078; 5,726,912; 5,689,415; 5,579,218; 5,351,200; 4,916,600; 4,646,223; 4,344,127; and 4,396,976, the entire disclosure of each being incorporated by reference herein.

Although not depicted in FIGS. 1A and 1B, a temperature of the one or more rods or wires 11 can be measured using, for example, a temperature measurement apparatus (e.g., an optical type pyrometer such as a thermometer such as a Raytex 500-1100° C. close focus fiber optical type from Raytex Equipment Company, Houston, Tex. or any other suitable alternative type) after any one of each the one of more heating units 32, 32', each of the one or more adaptable quenching zones 36, $\mathbf{36}^{(n-1)}$, each of the one or more a number of adaptable soaking zones 37, . . . $\mathbf{37}^{(n-1)}$, $\mathbf{37}^{(n)}$, or any combination of any of the preceding. In this manner, aspects of a heating-cooling operation 12 might be adjusted to correspond to a level appropriate for obtaining a prescribed or desired intermediate or finished product 18. Alternatively, a rod or wire 11 temperature might be measured while setting up a system, operation, unit, and/or zone when a rod or wire 11 is first provided to the system. In such a case, temperature measurement of a rod or wire 11 might be made as or after it travels through an operation, unit, and/or zone to set the appropriate level of operation of each.

For an understanding of aspects and embodiments of the present invention, Applicant provides the following nonlimiting examples. A heating-cooling operations 12 including a feed operation 14, heating unit 32, a cooling unit 8, and take-up unit 16 was constructed. The heating unit 32 (e.g., a Thermcraft 6' long, 1600° C. tube furnace manufactured by Thermcraft, Inc. of Winston Salem, N.C. 27177-2037) was equipped with a temperature measurement apparatus (a pyrometer (700-1400° C.) from Pyrometer Instrument Company of Windsor, N.J., 08561-0479) to measure the temperature of a wire 11 as it exits. As adaptable quenching zones 36 and adaptable soaking zone 37, the cooling unit 8 includes five (5) consecutive cells.

A first cell (20) is substantially of a type as second cell type 90 as depicted in FIG. 1C and further includes a heat source (e.g., a conventional electric immersion heater rated at 240V, 4.5 Kw, 3 phase sized to be capable of maintaining a liquid quenchant at a preselected temperature such as about 100° C.). As an adjusting mechanism 46 of a heat transfer adjuster 42, the cooling unit 8 includes an air regulator (a Dwyer Air Flow meter rated 0-50 L/min from Dwyer Instruments, Inc. of Michigan City, Ind.) in communication with gaseous media supply 44 (e.g., including an ACSI digital pressure meter (part No. 1200-0030,602056) rated at .XXPSI, a 0-200 PSF air gauge at Ashcroft.com (Ashcroft, Inc.) and a Speedaire 2Z767D, 200 PSI 125° F. air regulator (as sold at Grainger-.com)). As an adjusting mechanism 54 of a heat transfer adjuster 50, the cooling unit 8 includes a quenchant supplier 52 (such as a Bell & Gossett NBF-220110° C., 15PASI, 115V, 2 watt (P83033 model) re-circulating pump). The four (4) subsequent cells (21, 22, 23, and 24) are substantially of a type as first cell type 80 as depicted in FIG. 1C and further include a heat source (e.g., a conventional electric immersion heater rated at 240V, 4.5 Kw, 3 phase).

A coil of wire 11, conventional steel wire designated 1090 (e.g., AISI-SAE steel alloy designation) having a nominal diameter of 2.0 mm, or alternatively 1070 (e.g., AISI-SAE steel alloy designation) having a nominal diameter of 1.2 mm is mounted in feed operation 14 as in a typical industrial treatment operation. Wire 11 is fed through heating unit 32 for heating purposes, for example to about 930-1020° C. for wire 11 comprising steel. Heated wire 11 is then directed, for example, by roller guides (not depicted in FIGS. 1A and 1*b*) slightly above a first cell (20) configured to operate as an adaptable quenching zone 36, where a liquid quenchant 38 is displaced over the top of first cell by an introduction of a gaseous media to the liquid quenchant 38 resulting in foaming liquid quenchant that substantially completely covers wire 11. Wire 11 continuously travels through foaming liquid quenchant across the top of the subsequent four (4) cells (21, 22, 23, and 24). A first of the subsequent four (4) cells can be configured either as adaptable quenching zone 36 or an adaptable soaking zone 37 while the second through the fourth of the subsequent four (4) cells are typically configured as an adaptable soaking zone 37. After passing through foaming liquid quenchant of the fourth (24) of the subsequent four (4) cells, wire 11 dries by evaporation through the air to form an intermediate or finished product 18 (e.g., a treated wire) that passes through roller guides and is wound onto a reel at take-up unit 16 at the terminal end of heating-cooling operation 12.

Figure 3:
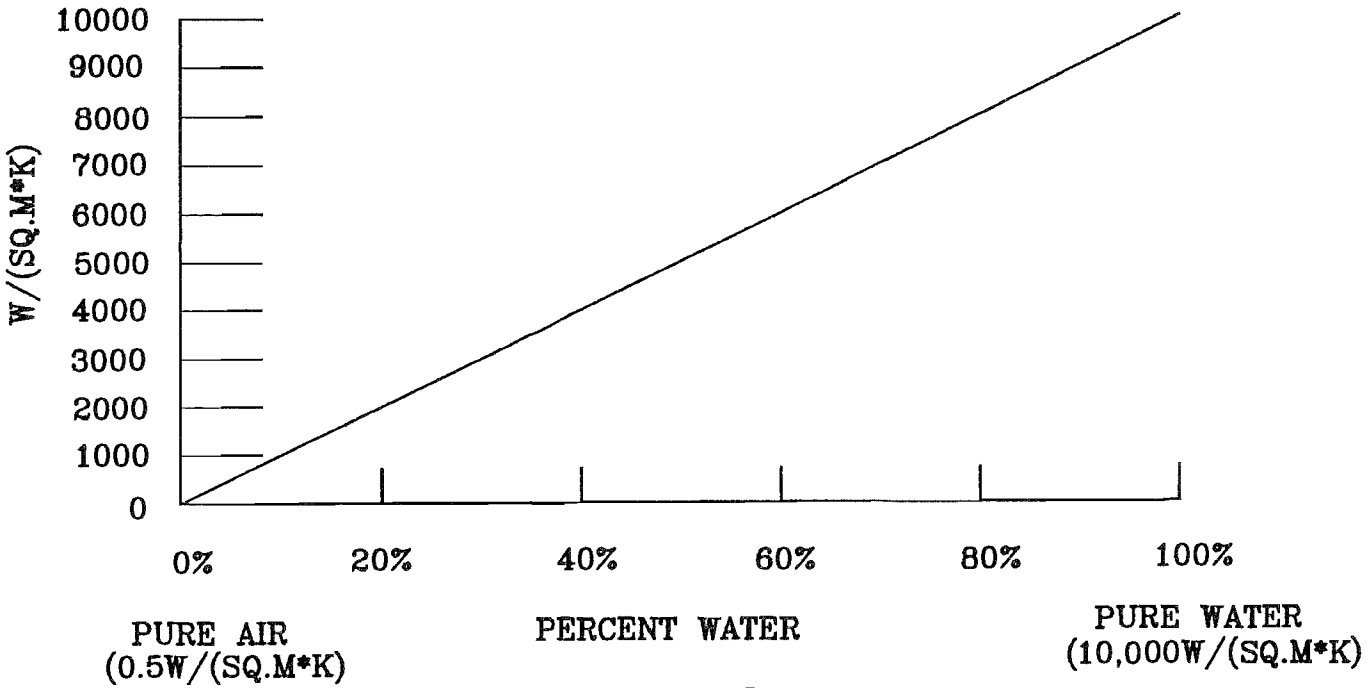
FIG. 3 illustrates a graph of a convection coefficient of air/water volume percentages of quenchant mixtures.

As discussed, a gaseous media (e.g., any one of one or more substantially inert gasses, one or more reactive gasses, or one or more inert gasses and one or more reactive gasses as may be appropriate) provided by gaseous media supply 44 may be used to form a foaming liquid quenchant. An amount of gaseous media entrapped in liquid quenchant 38 can be varied, for example, by varying a gaseous media flow rate and/or volume percentage of gaseous media entrapped to tailor a forced convective heat transfer coefficient. For example, FIG. 3 depicts a variation of a convective heat transfer coefficient for air entrapped in a liquid quenchant 80 where air is estimated to be about 0.5 W/(sq·m*K) and liquid quenchant 80 (e.g., substantially air free water) is estimated to be about 10,000 W/(sq·m*K). Such a forced convective heat transfer coefficient can vary linearly as an amount of air entrapped in liquid quenchant 80 (e.g., water) varies as shown in FIG. 3.

Figure 4:
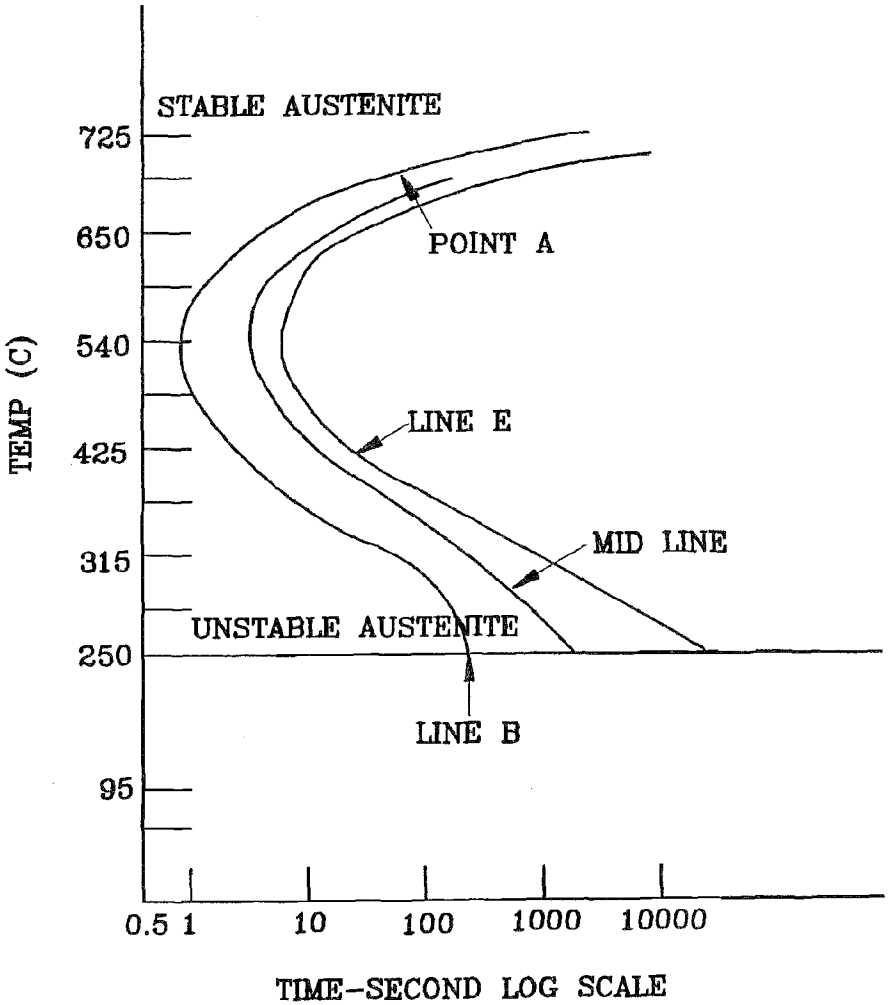
FIG. 4 depicts a typical Time-Temperature Transformation (TTT) curve for SAE 1080 steel.

FIG. 4 depicts a typical Time, Temperature, Transformation (TTT) curve for a 1080 steel (e.g., AISI-SAE steel alloy designation). A desired structure for an industrial drawing of a 1080 steel is theoretically developed by a heat treatment that involves heating the 1080 steel to a temperature (about 930-1020° C.) for a sufficient amount of time to obtain a substantially homogeneous structure in the stable austenite field and then very rapidly cooling (e.g., about 1 second) the austenized 1080 steel wire to about 540° C. so as to stay to the left of all the curves depicted in FIG. 4 while remaining in the unstable austenite field. Once at about 540° C., it would be desirable to maintain the 1080 steel wire at about 540° C. for an appropriate time (e.g., for about 6 seconds) so as to control a transformation of the unstable austenite structure to a pearlite structure (e.g., ferrite and cementite phases) having a prescribed form. Once the prescribed form is attained, it would be desirable to capture it, for example, by further cooling the traveling rod or wire. In a manufacturing environment this can be very difficult as it is a challenge to rapidly heat and cool a traveling rod or wire in a first instance and, to date, it has been a challenge to maintain substantially isothermal a traveling rod or wire. In particular, even if a heating unit and/or cooling unit could be maintained substantially isothermal, associated with a phase transforming rod or wire (e.g., unstable austenite to pearlite) is a heat of transformation that can heat the traveling rod or wire to raise its temperature in a manner that here to date has been substantially unaddressable.

Figure 5:
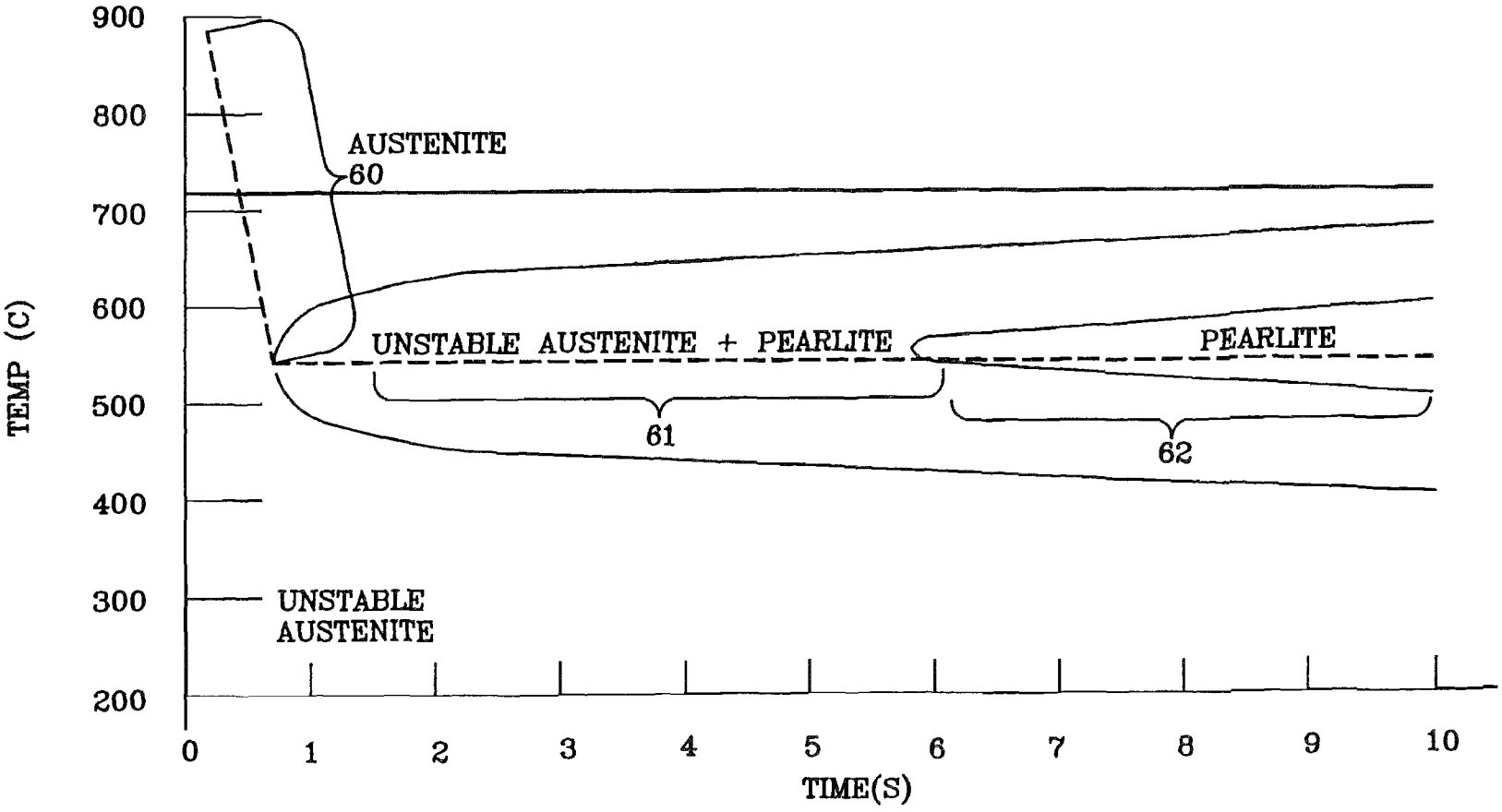
FIG. 5 depicts a typical Time-Temperature Transformation (TTT) curve for a eutectoid steel.

FIG. 5 depicts for an eutectoid steel (iron/carbon steel with about 0.8 to 0.83 carbon) a TTT curve and indicates that there could be at least three different rates of heat removal regions during a processing of a rod or wire having such a composition so as to capture the desired structure. According to aspects of embodiments of the present invention, such different rate of heat removal regions can be accommodated using a heating-cooling operation 12 having one or more adaptable quenching zones 36, . . . , $\mathbf{36}^{(n-1)}$ and one or more adaptable soaking zones 37, . . . , $\mathbf{37}^{(n-1)}$, $\mathbf{37}^{(n)}$. To that end, FIG. 5 can provide a guide as to how one might specify such one or more adaptable quenching zones 36, . . . , $\mathbf{36}^{(n-1)}$ and one or more adaptable soaking zones 37, . . . , $\mathbf{37}^{(n-1)}$, $\mathbf{37}^{(n)}$ to capture a desired structure.

If a rate of heat transfer is due mainly to convection, as is typically the case for industrial operations, then theoretically a rate of heat transferred (Q) to a surrounding media per unit surface area (A) can be represented by Newton's Law of Cooling:

$$Q/A = h(Tw - Tm);\ h = \frac{Q/A}{(Tw - Tm)}$$

1. Where (1) Q/A is the rate of heat transferred (Q) to the surrounding media per unit surface area (A) of the rod or wire (Q/A is sometimes also referred to as heat flux);
2. Tw is the temperature of a traveling rod or wire;
3. Tm is the temperature of a media absorbing or receiving the heat (e.g., a liquid quenchant, a foaming quenchant, a gaseous quenchant, . . . etc.); and
4. h is the convective heat transfer coefficient.

It will be appreciated that this simplification of a complex situation can be used as a guide for specifying a type and number of one or more adaptable quenching zones 36, . . . , $\mathbf{36}^{(n-1)}$ and one or more adaptable soaking zones 37, . . . , $37^{(n-1)}$, $37^{(n)}$. Once a type and number are specified, this simplification can be used as a guide for specifying how such varied rates of heat transfer might be achieved. For example as discussed herein, the heat flux can be varied by varying any one of a heat transfer coefficient (h), a temperature difference (Tw−Tm), or both. In turn as discussed herein, a heat transfer coefficient (h) can be varied by varying one or more of a quenchant composition, quenchant form, a quenchant composition and a quenchant form, a quenchant thermal capacity, a rate of providing or refreshing a quenchant proximate to traveling rod or wire, . . . etc.

For example, to reduce a traveling rod or wire temperature from about 930-1020° C. to 540° C. in the short time (e.g., about 1 second or less) a high rate of heat transfer would be desired. To that end, to increase a heat flux at region (60) of FIG. 5 some of the above options are available. It appears that there could be gains in heat flux by manipulating a temperature of a liquid quenchant 38 to achieve a greater temperature difference (Tw−Tm). Also it appears that there could be greater gains in heat flux by manipulating the convective heat transfer coefficient at region (60) of FIG. 5. Thus, at least one adaptable quenching zone 36 could be specified.

At region (61) of FIG. 5, a traveling rod or wire 11 is to be maintained substantially isothermal. However to so do, it would be desirable to account for heat released into a rod or wire 11 by the austenite to pearlite transformation (e.g., exothermic transformation). It appears that there could be challenges with heat flux control by manipulating a temperature of a liquid quenchant 38 to achieve a greater temperature difference (Tw−Tm). Alternatively, it appears that there could be better gains in heat flux by manipulating the convective heat transfer coefficient at region (60) of FIG. 5. Thus, at least one adaptable quenching zone 36 or at least one adaptable soaking zone 37 or at least one adaptable quenching zone 36 and at least one adaptable soaking zone 37 could be specified as would be appropriate to hold a traveling rod or wire 11 at temperature during the exothermic reaction of austenite to pearlite. At region (62) of FIG. 5, a traveling rod or wire 11 is to be maintained substantially isothermal, for example, to substantially complete the austenite to pearlite transformation then to be cooled to a safe operating temperature. Here it appears that having an option to control heat flux either by manipulating a temperature of a liquid quenchant 38 to achieve a greater temperature difference (Tw−Tm) or by manipulating the convective heat transfer coefficient at region (62) of FIG. 5 would be desirable. Thus, at least one adaptable soaking zone 37 could be specified as would be appropriate to control a temperature of a traveling rod or wire 11.

Some examples of cooling units 8, methods, and/or heating-cooling operations 12 according to an aspect of an embodiment of the present invention involving AISI-SAE 1090 steel are provided in Table 3 below.

TABLE 3 experimental data for AISI-SAE 1090 steel, nominal 2.0 mm diameter

| | Flow Rate, liters per minute | | | | | Percent Air | | | | | Diameter | Breaking | Tensile Strength |
|---|---|---|---|---|---|---|---|---|---|---|---|---|---|
| Example | Cell 20 | Cell 21 | Cell 22 | Cell 23 | Cell 24 | Cell 20 | Cell 21 | Cell 22 | Cell 23 | Cell 24 | (mm) | Load (N) | (Mpa) |
| 1 | 25 | 15 | 5 | 5 | 0 | 18% | 11% | 4% | 4% | 0% | 1.9609 | 3600 | 1192 |
| 2 | 20 | 10 | 10 | 5 | 0 | 14% | 7% | 7% | 4% | 0% | 1.9607 | 3599 | 1192 |
| 3 | 35 | 10 | 5 | 5 | 0 | 25% | 7% | 4% | 4% | 0% | 1.9641 | 3712 | 1225 |
| 4 | 35 | 10 | 10 | 5 | 5 | 25% | 7% | 7% | 4% | 4% | 1.9622 | 3735 | 1235 |
| 5 | 40 | 10 | 10 | 5 | 0 | 28% | 7% | 7% | 4% | 0% | 1.9624 | 3920 | 1296 |
| 6 | 35 | 30 | 0 | 0 | 0 | 25% | 21% | 05 | 0% | 0% | 1 9625 | 3947 | 1305 |
| 7 | 40 | 25 | 5 | 0 | 0 | 28% | 18% | 4% | 0% | 0% | 1.9613 | 3946 | 1306 |
| 8 | 35 | 25 | 10 | 5 | 0 | 25% | 18% | 7% | 4% | 0% | 1.9611 | 3951 | 1308 |
| 9 | 30 | 30 | 5 | 5 | 0 | 21% | 21% | 4% | 4% | 0% | 1.9613 | 3955 | 1309 |
| 10 | 40 | 20 | 5 | 5 | 5 | 28% | 14% | 4% | 4% | 4% | 1.9637 | 3989 | 1317 |
| 11 | 35 | 25 | 10 | 5 | 0 | 25% | 18% | 7% | 4% | 0% | 1.9622 | 3995 | 1321 |
| 12 | 35 | 30 | 5 | 5 | 5 | 25% | 21% | 4% | 4% | 4% | 1.9622 | 3998 | 1322 |
| 13 | 40 | 25 | 5 | 5 | 5 | 28% | 18% | 4% | 4% | 4% | 1.9620 | 4003 | 1324 |
| 14 | 35 | 25 | 10 | 10 | 0 | 25% | 18% | 7% | 7% | 0% | 1.9630 | 4022 | 1329 |
| 15 | 40 | 35 | 5 | 5 | 0 | 28% | 25% | 4% | 4% | 0% | 1.9631 | 4035 | 1333 |
| 16 | 35 | 35 | 10 | 5 | 0 | 25% | 25% | 7% | 4% | 0% | 1.9621 | 4055 | 1341 |
| 17 | 30 | 30 | 10 | 10 | 5 | 21% | 21% | 7% | 7% | 4% | 1.9614 | 4085 | 1352 |
| 18 | 40 | 30 | 10 | 5 | 5 | 28% | 21% | 7% | 4% | 4% | 1.9637 | 4128 | 1363 |
| 19 | 35 | 30 | 10 | 10 | 5 | 25% | 21% | 7% | 7% | 4% | 1.9624 | 4162 | 1376 |
| 20 | 40 | 30 | 10 | 10 | 5 | 28% | 21% | 7% | 7% | 4% | 1.9611 | 4171 | 1381 |

As can be seen from the data in Table 3, when a nominally 2 mm diameter AISI-SAE 1090 steel wire was processed using a heating-cooling operation 12 including a plurality of cells (20-24) configured as at least one adaptable quenching zone 36 and at least one adaptable soaking zone 37 the breaking loads and tensile strength of such wire 11 can be tailored. In particular, heated nominally 2 mm diameter AISI-SAE 1090 steel wire was provided to a cooling unit 8 including a liquid quenchant 38 (e.g., comprising water mixed with RAQ-TWT quenching solution as described above) and an adjusting mechanism 46 of gaseous media supply 44 to provide a gaseous media (e.g., comprising air) at different rates to the a plurality of cells (20-24) thereby forming a variety of foaming liquid quenchant configurations.

In Example 1 as summarized in Table 3, treating a nominal 2 mm diameter wire (1090 steel) using a cooling unit 8 configured with four of the plurality of cells (20-24) produced a treated wire having a breaking load of 3600 Newtons (N) and a tensile strength of 1192 Megapascals (MPa). In Example 6 as summarized in Table 3, treating the same nominal 2 mm diameter wire (1090 steel) using a cooling unit 8 configured with only two of the plurality of cells (20-24) produced a treated wire having an increased breaking load of 3947 N with a tensile strength of 1305 MPa. In Example 20 as summarized in Table 3, treating a nominal 2 mm diameter wire (1090 steel) using a cooling unit 8 configured with all of the plurality of cells (20-24) produced a treated wire having an increased breaking increasing to 4171 N and a tensile strength increasing to 1381 MPa. All of the examples as summarized in Table 3, a rod or wire 11 comprising a nominal 2 mm diameter wire (1090 steel) was run at a constant wire speed of about 7 meters per minute.

These examples demonstrate that by providing a cooling unit 8 configured according to various aspects of various embodiments of the present invention, improved breaking loads and tensile strengths of 1090 wire can be realized. Also, these examples demonstrate that by using methods according to various aspects of various embodiments of the present invention, improved breaking loads and tensile strengths of 1090 wire can be realized. Further, these examples demonstrate that by providing a heating-cooling operation 12 according to various aspects of various embodiments of the present invention, improved breaking loads and tensile strengths of 1090 wire can be realized. It will be apparent that similar or the same benefits can be achieved when treating rods or wires 11 having any variety of different compositions when providing cooling units 8 configured according to various aspects of various embodiments of the present invention, using methods according to various aspects of various embodiments of the present invention, and/or providing heating-cooling operations 12 according to various aspects of various embodiments of the present invention.

Figure 6:
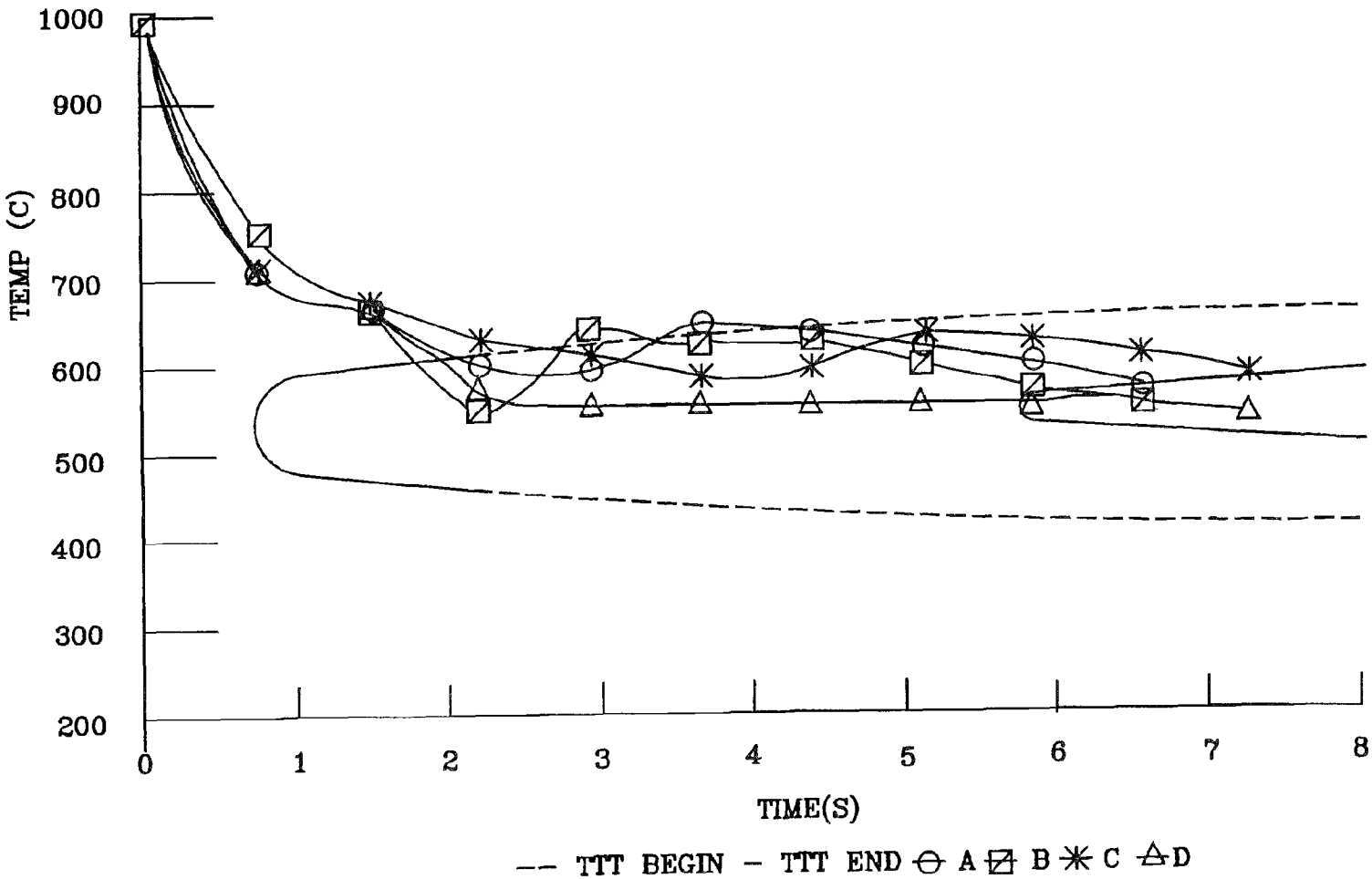
FIG. 6 depicts a first Time-Temperature Transformation (TTT) curve for SAE 1070 steel.
Figure 7:
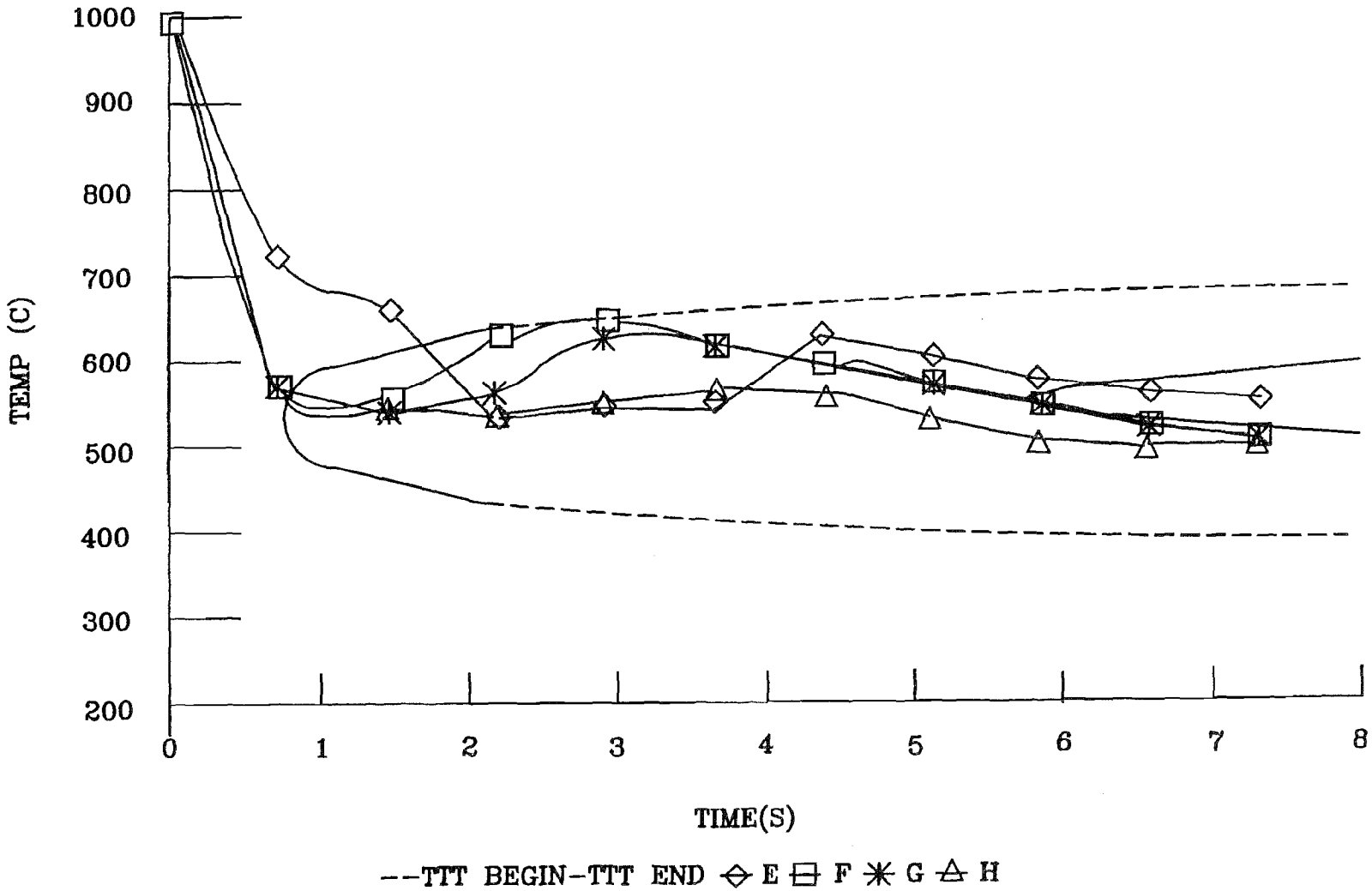
FIG. 7 depicts a second Time-Temperature Transformation (TTT) curve for SAE 1070 steel.
Figure 8:
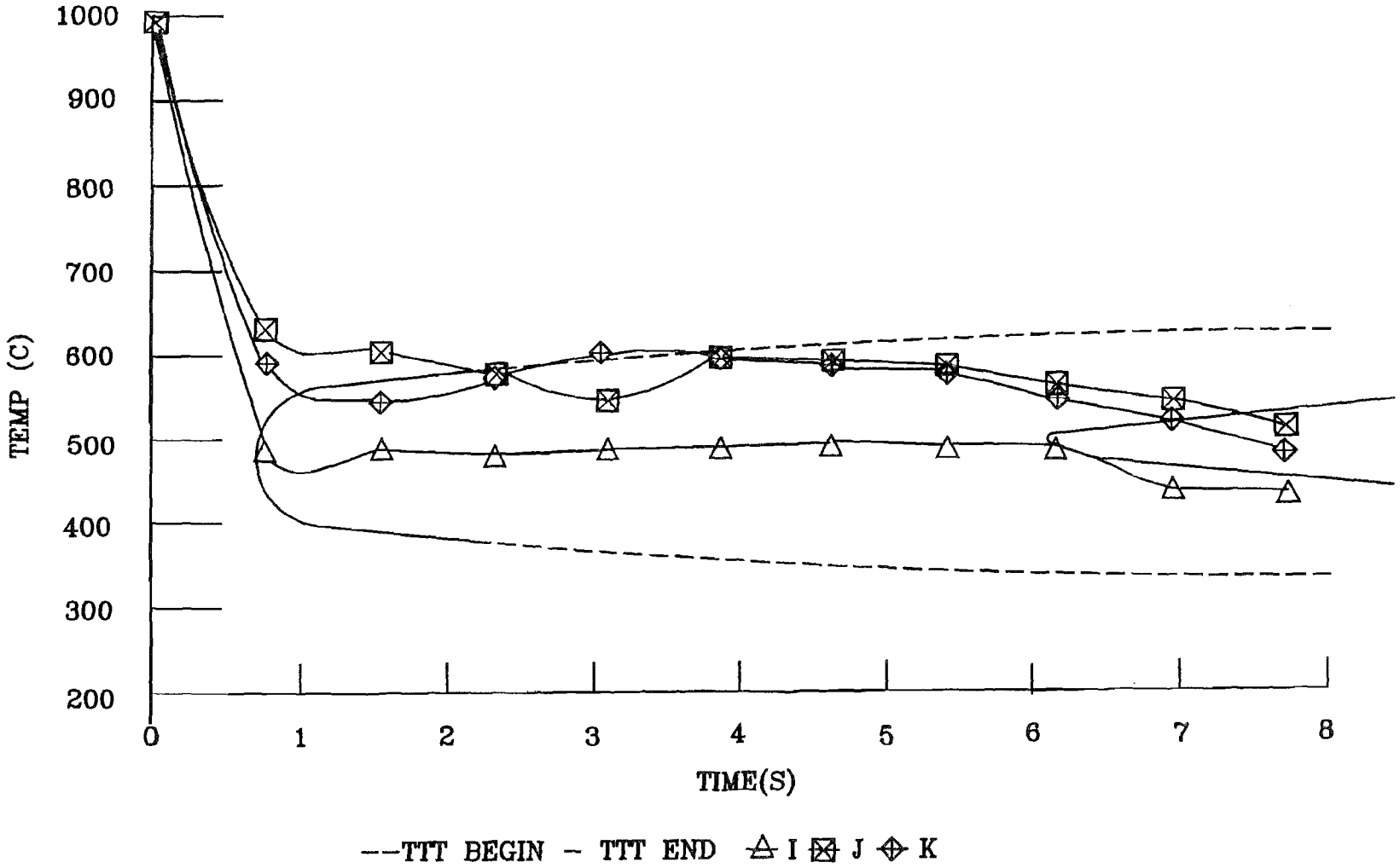
FIG. 8 depicts a third Time-Temperature Transformation (TTT) curve for SAE 1070 steel.

Some examples of cooling units 8, methods, and/or heating-cooling operations 12 according to an aspect of an embodiment of the present invention involving AISI-SAE 1070 steel are provided in Table 4 below, and FIGS. 6, 7, and 8 depict corresponding TTT curves.

In Examples B-E, the first cell (20) of the plurality of cells (20-24) was modified to apply an about 6 inch flat spray parallel (about ⅛ inch thick) to a traveling rod or wire 11.

In Examples F-K, the first cell (20) of the plurality of cells (20-24) was modified to provide liquid quenchant 38 at various flow rates in the range of 1.5-3 g/m while the traveling rod or wire 11 was encased in a nominally ⅜ inch diameter, 4 inch long pipe.

In Example A as summarized in Table 4, treating a nominal 1.2 mm diameter wire (1070 steel) using a cooling unit 8 as configured produced a treated wire having an increased breaking load of 1289 Newtons (N) and a tensile strength of 1148 Megapascals (MPa). In Example D as summarized in Table 4, treating a nominal 1.2 mm diameter wire (1070 steel) using a cooling unit 8 as configured produced a treated wire having an increased breaking load of 1276 N with a tensile strength of 1168 MPa. In Example H as summarized in Table 4, treating a nominal 1.2 mm diameter wire (1070 steel) using a cooling unit 8 as configured and a first cell (20) configured to provide full liquid quenchant 38 immersion of a heated traveling rod or wire 11 as it is guided through a pipe filled with flowing liquid quenchant 38 produced a treated wire having an increased breaking load of 1267 N with a tensile strength of 1153 MPa. In Example I as summarized in Table 4, treating a nominal 1.2 mm diameter wire (1070 steel) using a cooling unit 8 as configured and a first cell (20) configured to provide full liquid quenchant 38 immersion of a heated traveling rod or wire 11 as it is guided through a pipe filled with flowing liquid quenchant 38 produced a treated wire having an increased breaking load of 1407 N with a tensile strength of 1234 MPa. In all of the examples as summarized in Table 3, a rod or wire 11 comprising a nominal 2 mm diameter wire (1090 steel) was run at a constant wire speed of about 12.5 meters per minute.

TABLE 4 experimental data for AISI-SAE 1070 steel, nominal 1.2 mm diameter

| | Air Flow: Rate, liters per minute | | | | | Percent Air | | | | | Diameter | Breaking | Tensile Strength |
|---|---|---|---|---|---|---|---|---|---|---|---|---|---|
| Example | Cell 20 | Cell 21 | Cell 22 | Cell 23 | Cell 24 | Cell 20 | Cell 21 | Cell 22 | Cell 23 | Cell 24 | (mm) | Load (N) | (Mpa) |
| A | Round Spray | 0 | 0 | 0 | 0 | 20% | 100% | 00% | 100% | 100% | 1.196 | 1289 | 1148 |
| B | Flat Spray | 15 | 0 | 0 | 0 | 5% | 11% | 100% | 100% | 100% | 1.152 | 1541 | 1404 |
| C | Flat Spray | 0 | 0 | 0 | 0 | 5% | 100% | 100% | 100% | 100% | 1.162 | 1266 | 1135 |
| D | Flat Spray | 0 | 2 | 0 | 0 | 5% | 0% | FOAM | 0% | 0% | 1.179 | 1276 | 1168 |
| E | Flat Spray | 2 | 0 | 0 | 0 | 5% | FOAM | 100% | 100% | 100% | 1.151 | 1352 | 1214 |
| F | Pipe 2.6 g/m | 0 | 0 | 0 | 0 | 0% | 100% | 100% | 100% | 100% | 1.197 | 1287 | 1143 |
| G | Pipe 3 g/m | 0 | 0 | 0 | 0 | 0% | 100% | 100% | 100% | 100% | 1.183 | 1315 | 1197 |
| H | Pipe 2.6 g/m | 20 | 0 | 50 | 0 | 0% | 14% | 100% | 35% | 100% | 1.183 | 1267 | 1153 |
| I | Pipe 3 g/m | 20 | 0 | 50 | 50 | 0% | 14% | 100% | 35% | 35% | 1.205 | 1407 | 1234 |
| J | Pipe 1.5 g/m | 0 | 0 | 0 | 0 | 0% | 100% | 00% | 100% | 100% | 1.200 | 1250 | 1105 |
| K | Pipe 1.5 g/m | 0 | 0 | 0 | 0 | 0% | 100% | 00% | 100% | 100% | 1.210 | 1161 | 1010 |

As can be seen from the data in Table 4, a nominally 1.2 mm diameter AISI-SAE 1070 steel wire was processed using a heating-cooling operation 12 including a plurality of cells (20-24) configured as at least one adaptable quenching zone 36 and at least one adaptable soaking zone 37. In particular, heated nominally 1.2 mm diameter AISI-SAE 1090 steel wire was provided to a cooling unit 8 including a liquid quenchant 38 (e.g., comprising water mixed with RAQ-TWT quenching solution as described above), an adjusting mechanism 54 of quenchant supplier 52 to provide liquid quenchant 38 at different rates to a first cell (20) of the a plurality of cells (20-24), and an adjusting mechanism 46 of gaseous media supply 44 to provide a gaseous media (e.g., comprising air) at different rates to the plurality of cells (20-24) thereby forming a variety of foaming liquid quenchant configurations.

In Example A, the first cell (20) of the plurality of cells (20-24) was modified to apply an about ⅜ inch round spray perpendicular to a traveling rod or wire 11.

These examples demonstrate that by providing a cooling unit 8 configured according to various aspects of various embodiments of the present invention, improved breaking loads and tensile strengths of 1070 wire can be realized. Also, these examples demonstrate that by using methods according to various aspects of various embodiments of the present invention, improved breaking loads and tensile strengths of 1090 wire can be realized. Further, these examples demonstrate that by providing a heating-cooling operation 12 according to various aspects of various embodiments of the present invention, improved breaking loads and tensile strengths of 1070 wire can be realized. It will be apparent that similar or the same benefits can be achieved when treating rods or wires 11 having any variety of different compositions when providing cooling units 8 configured according to various aspects of various embodiments of the present invention, using methods according to various aspects of various embodiments of the present invention, and/or providing heating-cooling operations 12 according to various aspects of various embodiments of the present invention.

Figure 9:
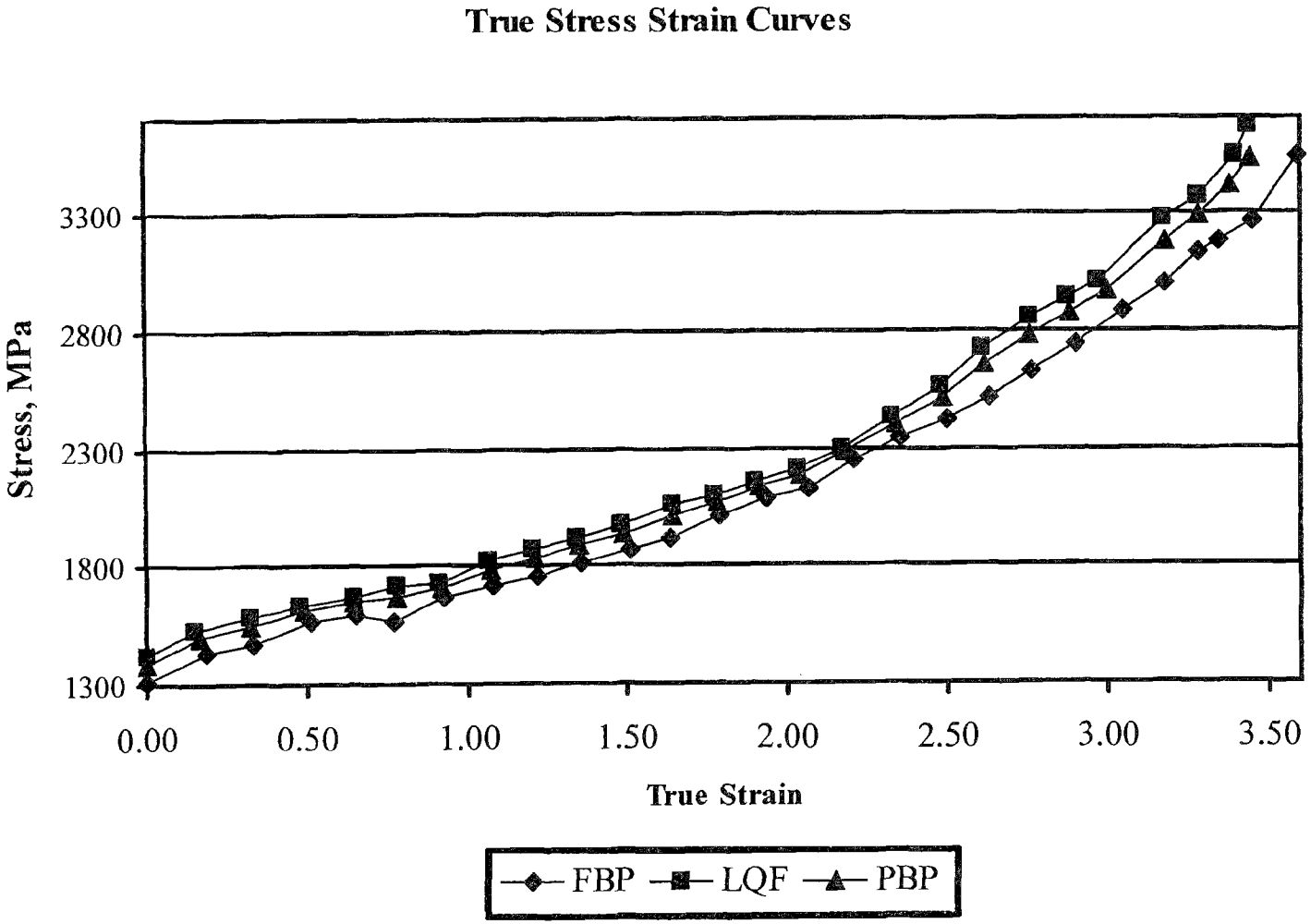
FIG. 9 depicts true stress strain curves for FBP product, PBP product and LQF product (a product according to an aspect of an embodiment of the present invention)

In a further example, an AISI-SAE 1090 drawn wire from one heat of steel was purchased, divided into lots and supplied to tire cord-manufacturing participants for comparison of a liquid quenchant fluidized bed technology (a cooling unit 8 and/or a heating-cooling operation 12 according to an aspect of an embodiment of the present invention and referred to as LQF hereinafter), a lead based operation (also referred to as a lead patenting and STD hereinafter), and an air fluidized sand bed based operation (also referred to as fluidized bed patenting and FBP hereinafter). The wire, nominally 1.95 mm was drawn to nominally 0.35 mm after patenting and plating using the various techniques (e.g., as described with reference to FIG. 2). True stress strain curves were generated by determining the tensile strength and true strain at each position in the die practice. The curves were similar and in each case the LQF product resulted in a higher final strength. Torsional properties for LQF and lead patented (STD) product were stable. Air fluidized sand (FBP) product was not stable in torsion. Results of the tensile strength and true strain study are summarized in Table 3 below, and FIG. 9 depicts the true stress strain curves of the study.

TABLE 3

| Tensile Strength And True Strain | | | | |
|---|---|---|---|---|
| FBP Stress | PBP Strain | PBP Stress | LQF Strain | LQF Stress |
| 1306.97 | 0.00 | 1384.73 | 0.00 | 1423.613 |
| 1431.57 | 0.17 | 1496.34 | 0.15 | 1528.724 |
| 1471.12 | 0.33 | 1546.86 | 0.33 | 1584.729 |
| 1568.93 | 0.49 | 1612.44 | 0.48 | 1634.198 |
| 1596.78 | 0.65 | 1647.89 | 0.65 | 1673.441 |
| 1565.06 | 0.78 | 1667.50 | 0.78 | 1718.718 |
| 1670.98 | 0.92 | 1709.94 | 0.91 | 1729.411 |
| 1717.49 | 1.07 | 1788.45 | 1.07 | 1823.933 |
| 1758.58 | 1.21 | 1830.70 | 1.20 | 1866.766 |
| 1812.38 | 1.35 | 1883.71 | 1.35 | 1919.369 |
| 1867.59 | 1.49 | 1937.57 | 1.48 | 1972.564 |
| 1917.48 | 1.64 | 2010.45 | 1.64 | 2056.933 |
| 2008.62 | 1.78 | 2070.22 | 1.78 | 2101.025 |
| 2084.90 | 1.91 | 2131.04 | 1.90 | 2154.105 |
| 2122.69 | 2.04 | 2184.13 | 2.03 | 2214.843 |
| 2252.95 | 2.18 | 2282.38 | 2.17 | 2297.098 |
| 2339.35 | 2.34 | 2400.18 | 2.33 | 2430.591 |
| 2418.11 | 2.48 | 2514.62 | 2.48 | 2562.876 |
| 2514.31 | 2.62 | 2653.78 | 2.61 | 2723.513 |
| 2624.33 | 2.76 | 2775.66 | 2.76 | 2851.328 |

TABLE 3-continued

| Tensile Strength And True Strain | | | | |
|---|---|---|---|---|
| FBP Stress | PBP Strain | PBP Stress | LQF Strain | LQF Stress |
| 2743.45 | 2.88 | 2873.14 | 2.87 | 2937.983 |
| 2881.87 | 3.00 | 2966.02 | 2.98 | 3008.094 |
| 2996.66 | 3.18 | 3178.37 | 3.18 | 3269.226 |
| 3126.61 | 3.29 | 3289.55 | 3.29 | 3371.019 |
| 3177.19 | 3.38 | 3419.53 | 3.4 | 3540.699 |
| 3259.02 | 3.44 | 3527.14 | 3.44 | 3661.198 |
| 3540.68 | | | | |

Microstructural analysis was completed on lead (STD) patented product and LQF patented product. The nominal diameter was about 2.0 mm, and various chemistries were examined. To complete the study, estimates were made of the percentages of fine pearlite, degenerative pearlite and bainite, and fragmented pearlite. In no instance were proeutectoid microconstituents observed. Results indicate that LQF product generally had a higher percentage of fine pearlite and similar amounts of degenerative pearlite and bainite and slightly less fragmented pearlite. Applicant anticipates that through further refinement, LQF patenting will be able to increase the amount of fine pearlite at the expense of degenerative pearlite and bainite. Results of the study are summarized in Table 4 below and depicted graphically in FIG. 10.

TABLE 4

Figure 10:
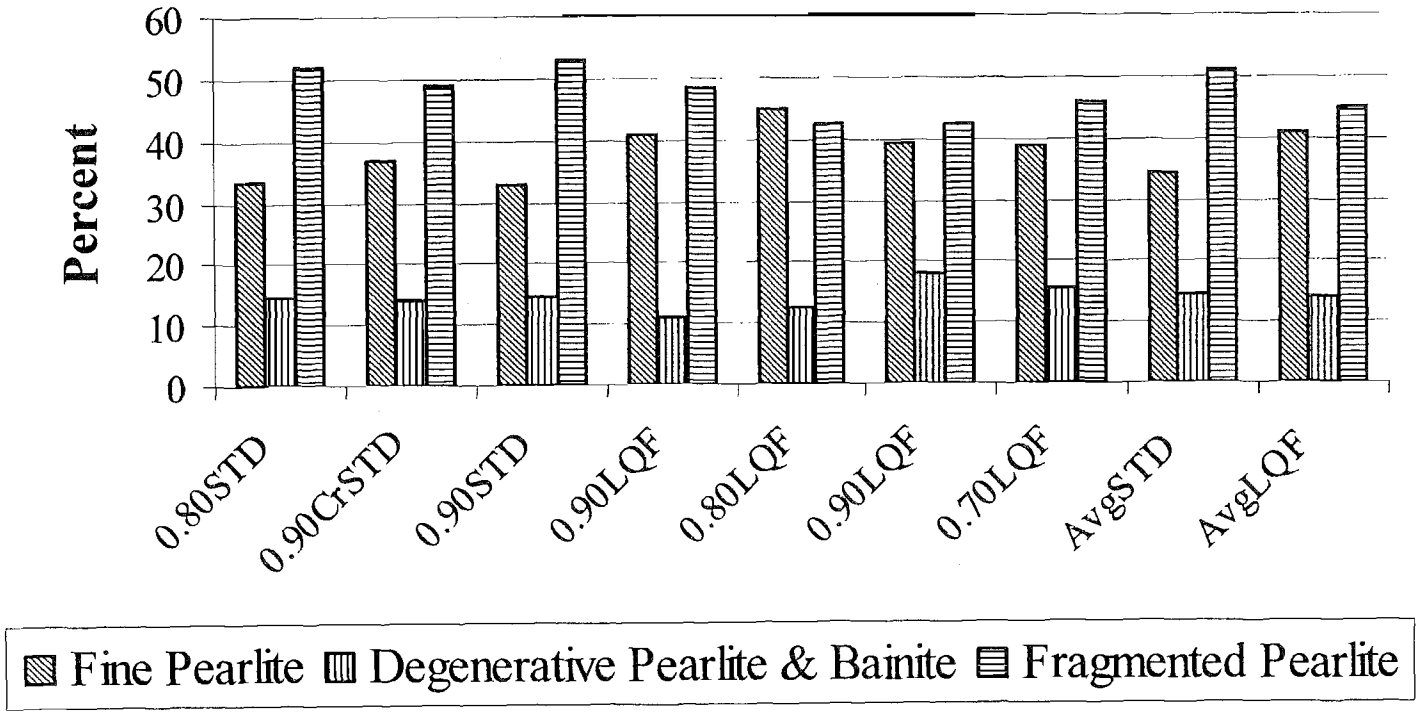
FIG. 10 depicts microstructural analysis results for PBP product and LQF product.

| Results of Microstructural Analysis | | | | | | | | | |
|---|---|---|---|---|---|---|---|---|---|
| AIS-SAE Designation | 1080 | 1090Cr | 1090 | 1090 | 1080 | 1090 | 1070 | | |
| Patenting Operation | STD | STD | STD | LQF | LQF | LQF | LQF | | |
| FIG. 10 Designation | 0.80STD | 0.90CrSTD | 0.90STD | 0.90LQF | 0.80LQF | 0.90LQF | 0.70LQF | AvgSTD | AvgLQF |
| Fine Pearlite | 33.4 | 36.9 | 32.9 | 40.6 | 45.0 | 39.3 | 38.9 | 34.4 | 40.9 |
| Degenerative Pearlite and Bainite | 14.6 | 14.4 | 14.4 | 10.9 | 12.7 | 18.2 | 15.4 | 14.5 | 14.3 |
| Fragmented Pearlite | 51.9 | 48.8 | 52.7 | 48.5 | 42.3 | 42.6 | 45.7 | 51.1 | 44.8 |

The illustrations and examples provided herein are for explanatory purposes and are not intended to limit the scope of the appended claims.

Certain modifications and improvements will occur to those skilled in the art upon a reading of the foregoing description. For example, other strand materials and metal shapes and sizes could also be accommodated by changes to any one of the system, one or more operations, one or more units, one or more zones, and/or one or more processing steps, depending on the requirements of a system, an operation, a unit, a zone, a product, and/or a process. It should be understood that all such modifications and improvements have been deleted herein for the sake of conciseness and readability but are properly within the scope of the following claims.

LIST OF ITEM NUMBERS cooling unit 8
rod or wire manufacturing system 10
rod or wire 11
heating-cooling operation 12
feed unit 14
take-up unit 16 intermediate product 17
intermediate product 17'
intermediate product 17"
intermediate product $\mathbf{17}^{(n-1)}$
intermediate product $\mathbf{17}^{(n)}$
intermediate or finished product 18
first drawing unit 20
second drawing unit 20'
third drawing unit 20"
first cleaning unit 24
second cleaning unit 24'
coating unit 26
stranding unit 30
first heating (annealing) unit 32
second heating (annealing) unit 32'
cooling (quenching) unit 34
adaptable quenching zone 36
adaptable quenching zone 36'
adaptable quenching zone $\mathbf{36}^{(n-1)}$
adaptable quenching zone $\mathbf{36}^{(n)}$
adaptable soaking zone 37
adaptable soaking zone 37'
adaptable soaking zone $\mathbf{37}^{(n-1)}$
adaptable soaking zone $\mathbf{37}^{(n)}$
liquid quenchant 38
quenchant reservoir 40
first heat transfer adjuster 42
gaseous media supply 44
gaseous media cleaner 45
adjusting mechanism 46
pressure equalizer 47
pressure regulator 48
second heat transfer adjuster 50
quenchant supplier 52
adjusting mechanism 54
flow control 56
quenchant level control 60
quenchant level setter 62
quenchant supply 64
quenchant resupplier 66
controller 70
first cell type 80
diffuser 82
porous media 84
socket 86
90 second cell type 90
line 92
selector 94
bypass 96
residue remover 98

What is claimed is:

1. A cooling unit useable with a rod or wire manufacturing system including (a) at least one feed unit capable of continuously providing at least one rod or at least one wire, (b) at least one heating unit capable of heating to a preselected temperature the at least one continuously provided rod or the at least one continuously provided wire, and (c) at least one take-up unit capable of continuously gathering the at least one heat treated rod or the at least one heat treated wire, the cooling unit comprising:

(a) a quenchant reservoir configured to contain a liquid quenchant; and (b) one or more second cell types and one or more first cell types wherein:

(i) each second cell type comprises a diffuser configurable to either:

1. provide a liquid quenchant when the liquid quenchant is communicated to the diffuser in a first preselected manner to thereby comprise at least one heat transfer coefficient adaptable quenching zone capable of quenching to a soaking temperature the at least one continuously provided rod or the at least one continuously provided wire; or 2. create a foaming liquid quenchant when the liquid quenchant and a gaseous media are communicated to the diffuser in a second preselected manner to thereby comprise at least one heat transfer coefficient adaptable quenching zone capable of quenching to a soaking temperature the at least one continuously provided rod or the at least one continuously provided wire;

(ii) each first cell type comprises a diffuser configurable to create a foaming liquid quenchant when the liquid quenchant and a gaseous media are communicated to the diffuser in a third preselected manner to thereby comprise at least one heat transfer coefficient adaptable soaking zone capable of maintaining substantially at the soaking temperature the at least one continuously provided rod or the at least one continuously provided wire so as to be capable of substantially completing a heat treating;

wherein the first cell type is capable of providing a quenchant as a foam above an upper level of the first cell type controllable by a first heat transfer adjuster including a gaseous media supply and an adjusting mechanism in communication with a diffuser including a porous media submerged in the quenchant, wherein the second cell type is capable of providing a quenchant as a foam above an upper level of the second cell type controllable by a first heat transfer adjuster including a gaseous media supply and an adjusting mechanism in communication with a diffuser including a porous media submerged in the quenchant and providing liquid quenchant through a quenching supplier at an appropriate volume and pressure to well up a liquid quenchant above the upper level of the second cell type;

wherein the second cell type is configurable to bypass quenchant supplier when liquid quenchant is provided as a foam above the upper level of the second cell type by a selector capable of isolating the volume of the second cell type from quenchant reservoir while receiving liquid quenchant from quenchant supplier, wherein the wire or rod is guided in use slightly above the second and first type cells.

2. The cooling unit according to claim 1, wherein the first cells are further configurable to provide a gaseous quenchant when gaseous media is not communicated to the diffuser in a fourth preselected manner to thereby comprise at least one heat transfer coefficient adaptable soaking zone capable of maintaining substantially at the soaking temperature the at least one continuously provided rod or the at least one continuously provided wire so as to be capable of substantially completing a heat treating.

3. The cooling unit according to claim 1, further comprising:

a first heat transfer adjuster configured to communicated gaseous media in a plurality of preselected manners to the one or more second cell types, or one or more first cell types, or one or more second cell types and one or more first cell types, or two or more second cell types; and a second heat transfer adjuster configured to communicated liquid quenchant in a plurality of preselected manners to one or more second cell types or two or more second cell types.

4. The cooling unit according to claim 1, wherein the one or more first cell types are configured to be capable of recirculating liquid quenchant within quenchant reservoir so as to maintain a temperature of liquid quenchant substantially homogeneous.

5. The cooling unit according to claim 1, further comprising a quenchant level control.

6. The cooling unit according to claim 3, wherein the first heat transfer adjuster further comprises a pressure equalizer.

7. A method of manufacturing a rod or wire comprising the steps of:

(a) continuously providing at least one rod or at least one wire;

(b) heating the at least one continuously provided rod or the at least one continuously provided wire to a preselected temperature;

(c) quenching the at least one continuously provided rod or the at least one continuously provided wire to a preselected soak temperature by using a quenching zone function of a cooling unit according to one of the preceding claims;

(d) substantially maintaining the at least one continuously provided rod or the at least one continuously provided wire at the preselected soak temperature so as to substantially complete a heat treatment of the at least one continuously provided rod or the at least one continuously provided wire by using a soak zone function of the cooling unit; and (e) continuously gathering the at least one heat treated rod or the at least one heat treated wire.

8. The method according to claim 7, wherein continuously providing comprises continuously providing any one of a plurality of rods or a plurality of wires or a plurality of rods and a plurality of wires and any one of:

(a) wherein the quenching comprises quenching the any one of the plurality of continuously provided rods or the plurality of continuously provided wires or the plurality of continuously provided rods and the plurality of continuously provided wires to a plurality of preselected temperatures; or (b) wherein substantially maintaining comprises substantially maintaining the any one of the plurality of continuously provided rods or the plurality of continuously provided wires or the plurality of continuously provided rods and the plurality of continuously provided wires at a plurality of preselected soak temperatures.

9. The method according to claim 7, wherein continuously providing comprises continuously providing any one of a plurality of rods or a plurality of wires or a plurality of rods and plurality of wires comprising any one of:

(a) materials comprising a variety of substantially different compositions; or (b) materials comprising a variety of substantially different cross-sectional profiles; or (c) materials comprising a variety of substantially different diameters; or materials comprising a variety of substantially different compositions and a variety of substantially different cross-sectional profiles.

* * * * *